US009205637B2

(12) United States Patent
Hargreaves et al.

(10) Patent No.: US 9,205,637 B2
(45) Date of Patent: Dec. 8, 2015

(54) FLEXOGRAPHIC PRINTING METHOD AND FLEXOGRAPHIC PRINTING APPARATUS HAVING CONTROL MEANS FOR DRIVING PRINTING ROLLER

(75) Inventors: Colin Hargreaves, Accrington (GB); David Hargreaves, Accrington (GB)

(73) Assignee: Emerson & Renwick LTD, Lancashire (GB)

( * ) Notice: Subject to any disclaimer, the term of this patent is extended or adjusted under 35 U.S.C. 154(b) by 326 days.

(21) Appl. No.: 13/119,935

(22) PCT Filed: Jan. 12, 2010

(86) PCT No.: PCT/GB2010/000041

§ 371 (c)(1),
(2), (4) Date: Jul. 15, 2011

(87) PCT Pub. No.: WO2010/079346

PCT Pub. Date: Jul. 5, 2010

(65) Prior Publication Data

US 2011/0259221 A1 Oct. 27, 2011

(30) Foreign Application Priority Data

Jan. 12, 2009 (GB) ..... 0900431.8

(51) Int. Cl.
*B41F 5/04* (2006.01)
*B41F 5/24* (2006.01)
*B41F 33/00* (2006.01)

(52) U.S. Cl.
CPC .. *B41F 5/24* (2013.01); *B41F 33/00* (2013.01)

(58) Field of Classification Search
CPC ..... B41F 5/24
USPC ..... 101/219, 221, 223, 225, 228
See application file for complete search history.

(56) References Cited

U.S. PATENT DOCUMENTS 3,921,519 A 11/1975 Zimmer
3,926,111 A * 12/1975 Bohm ..... 101/116

(Continued)

FOREIGN PATENT DOCUMENTS

DE 3344131 6/1985
DE 201 16 246 3/2002

(Continued)

OTHER PUBLICATIONS

International Search Report and Written Opinion for PCT/GB2010/000041 mailed Apr. 27, 2010.

(Continued)

*Primary Examiner* — Blake A Tankersley
*Assistant Examiner* — Quang X Nguyen
(74) *Attorney, Agent, or Firm* — Knobbe, Martens, Olson & Bear, LLP

(57) ABSTRACT

The present invention relates to a flexographic method of printing and a flexographic printing apparatus whereby the repeat length is greater than the circumference of the printing roller. This may be achieved by controlling the rotation of the printing roller as a non-printing zone of the printing roller passes a moving web such that an associated non-printed region formed on the web has a length that is greater than the non-printing zone. The rotation of the printing roller may be controlled by suspending the rotation of the printing roller or reducing the speed of rotation when the non-printing zone is in registration with the web and then increasing the speed of rotation to a predetermined printing speed as a printing zone of the printing roller comes into registration with the web.

27 Claims, 29 Drawing Sheets

(56) References Cited

U.S. PATENT DOCUMENTS

| | | | | |
|---|---|---|---|---|
| 3,990,363 | A | 11/1976 | Vertegaal | |
| 5,213,033 | A | 5/1993 | Bourgeois et al. | |
| 6,123,022 | A | 9/2000 | Takata | |
| 6,948,426 | B2 | 9/2005 | Rush | |
| 2009/0064881 | A1 * | 3/2009 | Belanger et al. | 101/226 |
| 2011/0283903 | A1 | 11/2011 | Hargreaves et al. | |

FOREIGN PATENT DOCUMENTS

| | | | | | |
|---|---|---|---|---|---|
| DE | 10145957 | | | 10/2002 | |
| EP | 1604820 | | | 12/2005 | |
| GB | 2 429 430 | | | 2/2007 | |
| JP | 58197084 | A | * | 11/1983 | B41M 1/00 |
| JP | 2002234139 | A | * | 8/2002 | B41F 33/00 |

OTHER PUBLICATIONS

International Preliminary Report on Patentability and Written Opinion issued Jul. 21, 2011 to international application No. PCT/GB2010/000041.

International Search Report dated Nov. 25, 2009 issued to international application No. PCT/GB2009/002015.

Written Opinion of the International Search Authority for International Application No. PCT PCT/GB2009/002015.

* cited by examiner

WEB RUNNING
PRINT ROLL RUNNING

WEB RUNNING
PRINT ROLL PAUSED

FLEXOGRAPHIC PRINTING METHOD AND FLEXOGRAPHIC PRINTING APPARATUS HAVING CONTROL MEANS FOR DRIVING PRINTING ROLLER

CROSS-REFERENCE TO RELATED APPLICATIONS

This application is the U.S. National Phase under 35 U.S.C. §371 of International Application No. PCT/GB2010/000041, filed Jan. 12, 2010, designating the United States and published in English on Feb. 25, 2010 as WO 2010/079346, which claims priority to United Kingdom Application No. 0900431.8, filed Jan. 12, 2009.

FIELD OF INVENTION

The present invention relates to a flexographic method of printing and a flexographic printing apparatus.

BACKGROUND ART

Flexographic printing systems typically comprise a rotatable printing cylinder (sometimes referred to as a "printing roller") and an anilox roller for transferring ink to the printing cylinder. The printing cylinder is configured and continuously rotated with respect to a moving web so as to repeatedly print an image on a moving web. In conventional flexographic printing systems, the rotational speed of the printing cylinder is synchronized with the web line-speed. Hence, the size of the image and image repeat length (i.e. the distance between common points of two adjacent repeat images) is determined by the useful printing circumference of the printing cylinder. The theoretical limit of the size of the image and image repeat length is the maximum viable circumference of the printing cylinder. Typically, the entire printing cylinder surface is used for printing. Alternatively, a section of the printing cylinder circumference may be blank and non printing. This non-printing region is provided to delineate between individual printed images and to facilitate the joining of different pattern segments.

Accordingly, it is not possible for conventional flexographic printing systems to print images with a size and repeat length that is larger than the circumference of the printing cylinder. For example, a flexographic printing system having a printing cylinder with a circumference of 1 m can not print images with a repeat length greater than 1 m. Hence, a conventional flexographic printing system can not print images with a "wall height" repeat (typically 2.4 m or more).

Typically, large repeats (images having a large size and repeat length) have been obtained using alternative printing method such as the so-called "flat printing method" by means of flat stencils or the so-called "block printing method" by means of printing blocks. Although any size of image or repeat length may be achieved, the mechanical process of manufacture is laborious and the rate of production thereof is limited.

The problem of restricted image size has also been previously solved by reducing the rotational speed of the printing cylinder with respect to the web line-speed so as to print a stretched or elongated image on the web. This type of printing process is commonly referred to as "slip" printing. Although the image is larger than the printing region of the printing cylinder, the image produced by slip printing is considered to be an inferior quality.

Designers are creating designs that are becoming ever more challenging to print. For example, designers are creating designs having a large size format, remotely spaced images, random images and/or multiple colours. In many instances it is not possible to reproduce these designs using a conventional flexographic printing system due to the image size limitations, repeat length restrictions and the number of print stations required. Hence, to date, these challenging print designs are often only produced using digital printing technologies as opposed to flexographic printing technology. However, digital printing technologies have their own limitations and can for example, only be used on certain substrates and by using a limited range of inks and ink technologies.

One particularly challenging design for printing is a large format design (e.g. for wallpaper) which has a large almost continuous design presented over the whole wall length with multiple repeated images at relatively large repeat separations. Using a conventional flexographic printing process to try and achieve this design would require large numbers of print stations to build up the design in stages. In practice this arrangement would be unsuitable because it would be inherently difficult to control for quality, it would expensive and relatively inflexible.

There is therefore a need for a new flexographic printing method and flexographic printing system to address or overcome one or more of the problems discussed above.

SUMMARY OF THE INVENTION

A first aspect of the invention relates to a method of printing an image on a web by means of a flexographic printing cylinder wherein the repeat length is greater than the circumference of the printing cylinder.

The production of a continuous web or of pieces of web printed with an image having a repeat length which is greater than the circumference of each printing cylinder will be possible according to the invention provided the following features are applied:

(a) using a printing cylinder having a surface with at least one patterned area and at least one non-patterned area, wherein the at least one patterned area and at least one non-patterned area are parallel to the longitudinal axis of the printing cylinder;

(b) applying ink to the at least one patterned area of the printing cylinder using an ink application means;

(c) rotating the inked printing cylinder at a predetermined printing speed when a patterned area is in registration with the web;

(d) suspending rotation of the printing cylinder or reducing the rotational speed of the printing cylinder from the printing speed when a non-patterned area is in registration with the web; and (e) increasing the rotation of the printing cylinder to the predetermined printing speed as a patterned area comes into registration with the web.

In this arrangement, a printed region is formed on the web when a patterned area passes over the web and a non-printed region is formed on the web when a non-printing area passes over the web. The image printed in the printed region on the web corresponds to the pattern of the associated patterned area.

By suspending the rotation of the printing cylinder or reducing the rotational speed of the printing cylinder when the non-patterned area is in registration with the moving web, the length of the non-printed region will be greater than the circumferential length of the associated non-patterned area. Thus, the overall repeat length is greater than the circumference of the printing cylinder.

By controlling the rotation of the printing cylinder when the non-patterned area is in registration with the web (e.g. by controlling the time intervals between suspending and recommencing rotation of the printing cylinder and/or by controlling the variation of rotational speed when the non-patterned area is in registration with the web) it may be possible to produce a variety of different types of repeat lengths. For example, it may be possible to control the rotation of the printing cylinder when the non-patterned area is in registration with the web so as to have:—

(i) at least substantially identical time length intervals between the printed regions and thereby produce at least substantially identical repeat lengths;

(ii) random time intervals between the printed regions and thereby produce random repeat lengths;

(iii) variable time intervals between the printed regions and thereby produce variable repeat lengths.

If the rotational speed of the printing cylinder is reduced from the printing speed when a non-patterned area is in registration with the web, it is preferable to significantly reduce the rotational speed (e.g. to a creeping speed).

Preferably, the rotation of the printing cylinder is recommenced or the rotational speed of the printing cylinder is increased after the web has moved a predetermined distance and/or a predetermined time period has lapsed.

In an embodiment of the invention, the rotation of the printing cylinder may be reversed when a non-patterned area is in registration with the web. The reversal of motion may optimise the acceleration of the printing cylinder back up to the predetermined printing speed as the patterned area comes into registration with the web.

In an embodiment, it is possible to lift or move the printing cylinder away from the web when the non-patterned area passes over the web and then re-position the printing cylinder in printing contact with the web as the patterned area comes into registration with the web. Adjusting the printing cylinder as such helps to avoid ink contamination of the web between printed regions.

Typically the ink application means is arranged with respect to the printing cylinder so as to apply ink to the patterned area. In an embodiment, it is possible to raise or move the ink application means away from the printing cylinder surface and then re-position the ink application means in inking contact with the printing cylinder surface. Adjusting the ink supply means as such helps to prevent excessive ink from being applied to the patterned area of the printing cylinder which in turn helps to avoid ink contamination of the web and improve the printing quality. The ink application means may be moved away from the printing cylinder when the non-patterned region comes into registration with the ink supply means and may be re-positioned into inking contact with the printing cylinder when the patterned region comes into registration with the printing cylinder. Alternatively or additionally, the ink application means may be moved away from the printing cylinder as and when the printing cylinder is moved away from the web and may be re-positioned with respect to the printing cylinder as and when the printing cylinder is re-positioned in printing contact with the web.

In an embodiment, it is possible to accurately align a patterned area of the printing cylinder with respect to a desired printing region on the web. Preferably, this may be achieved using a key mark registration system to print and scan a mark on the web with respect to every desired printed region. By printing a mark for every desired printed region a design comprising a plurality of different images (e.g. sequential images and/or overlaid images) may be accurately printed.

A second aspect of the invention relates to a method of printing a design on a web by means of a plurality of printing cylinders. Each printing cylinder is configured to print a different part of a design wherein at least one of the parts of the design has a repeat length that is greater than the circumference of the printing cylinder associated with printing that part of the design.

The production of a design on a web by means of a plurality of printing cylinders, wherein at least part of the design has a repeat length that is greater than the circumference of the printing cylinder associated with the printing that part of the design will be possible provided the following features are applied:

(a) using at least one printing cylinder having a surface with at least one patterned area and at least one non-patterned area, wherein the at least one patterned area and at least one non-patterned area are parallel to the longitudinal axis of the printing cylinder, (b) applying ink to the at least one patterned area of the printing cylinder using an ink application means;

(c) rotating the printing cylinder at a predetermined printing speed when a patterned area is in registration with the web to be printed;

(c) suspending rotation of the printing cylinder or reducing the rotational speed of the printing cylinder from the printing speed when a non-patterned area is in registration with the web to be printed; and (d) increasing the rotation of the printing cylinder to the predetermined printing speed as a patterned area comes into registration with the web.

A third aspect of the invention relates to a printing station apparatus for performing the method as indicated in the first aspect of the invention, the printing station comprising a printing cylinder and an ink application means. The printing cylinder comprises at least one patterned area and at least one non-patterned area. The printing cylinder is rotatably arranged over a common printing track, and means are provided for supporting and guiding the material to be printed along the printing track, while the apparatus has means for rotating the printing cylinder at a printing speed when a patterned area is registration with the material to be printed on, suspending rotation or significantly reducing the rotational speed of the printing cylinder when at least one of the non-patterned areas is in registration with the material to be printed on and then increasing the speed of the printing cylinder to printing speed as a patterned area comes into registration with the web.

Preferably, the printing station further comprises an impression roller that is arranged in opposing and parallel association with the printing cylinder whereby the material to be printed is guided along the printing track between the printing cylinder and the impression roller. The impression roller is configured to support the rear side of the material so as to enhance the printing of the image.

The fourth aspect of the invention provides for a printing apparatus for printing a design by means of a plurality of printing cylinders. Each printing cylinder is configured to print a different part of the design, wherein at least a part of the design has a repeat length greater than the circumference of the associated printing cylinder. The printing apparatus comprises means for transferring one or more printable substrates to one or more print stations, each print station comprising (a) a printing cylinder comprising at least one patterned area and at least one non-patterned area; (b) ink supply means for supplying ink to the patterned area; (c) control means for rotating the printing cylinder at a printing speed when the patterned area is in registration with the printable substrate and for suspending and restarting or reducing and increasing the rotational speed of the printing cylinder when the non-patterned area is in registration with the printable substrate such that the print repeat is greater than the printing circumference of the cylinder.

DESCRIPTION OF THE DRAWINGS

For a better understanding of the invention, and to show how the same may be carried into effect, reference will now be made, by way of example, to various specific embodiments of the different aspects of the invention as shown in the accompanying diagrammatic drawings, in which.

DETAILED DESCRIPTION OF THE INVENTION

For the purposes of this document, the term "web" is to be understood as any material or substrate that is suitable for feeding through a flexographic printing station and on which an image may be printed. The web may comprise a non-porous material, for example a non-porous substrate suitable for food packaging. The web may include plastic, metallic films, cellophane or paper material. The web may be a continuous web or individual pieces of web. The web may be, for example, a continuous sample of wallpaper and individual piece of wallpaper.

For the purposes of this document, the term "ink" is to be understood as any material that is suitable for forming an image on a web using a flexographic printing process. The ink may be dependent on the type of web being printed. The ink may be a solvent-based ink, water-based ink, electron beam curing ink, ultraviolet curing ink or a two part chemically curing ink.

For the purposes of this document, the term "image" is to be understood as any type of image that may be printed on a web. The image may have a predetermined shape and/or colour. It is to be understood that a "design" printed on a web may comprise a plurality of images and the plurality of images may comprise multiple different shapes and/or multiple different colours.

According to the invention a flexographic printing station suitable for printing at least one image on a web comprises a rotatable printing roller (R), to print at least one image on a web (W), an anilox roller (A) to transfer ink onto the printing roller, an ink chamber (C) comprising ink, an impression roller (IR), a drive system (not shown) to rotatably drive the printing roller and web line means (not shown) to feed the web through the flexographic printing station.

Figure 1A:
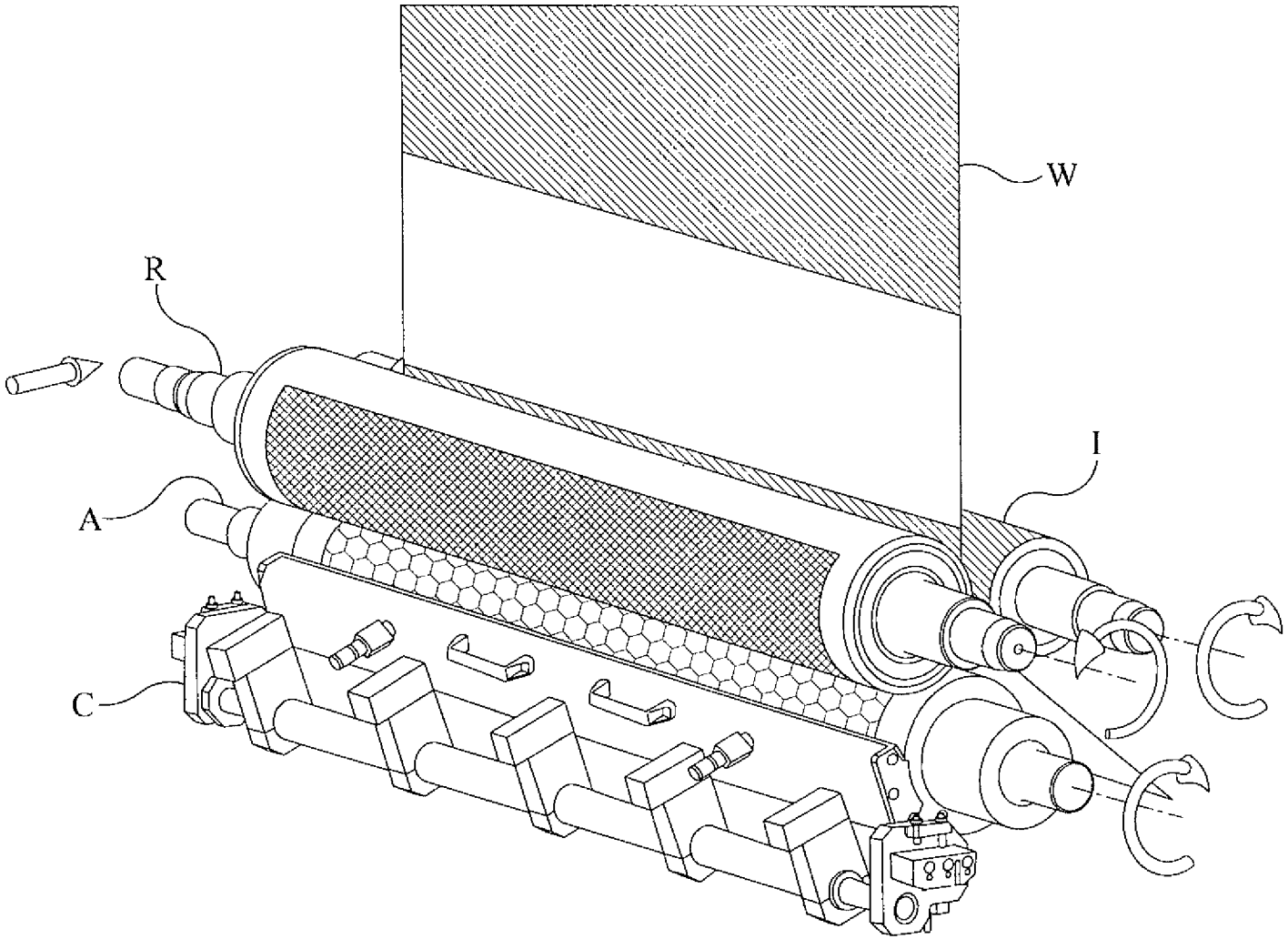
FIG. 1*a* is a perspective view of an embodiment of an offset flexographic printing station in printing mode.
Figure 1B:
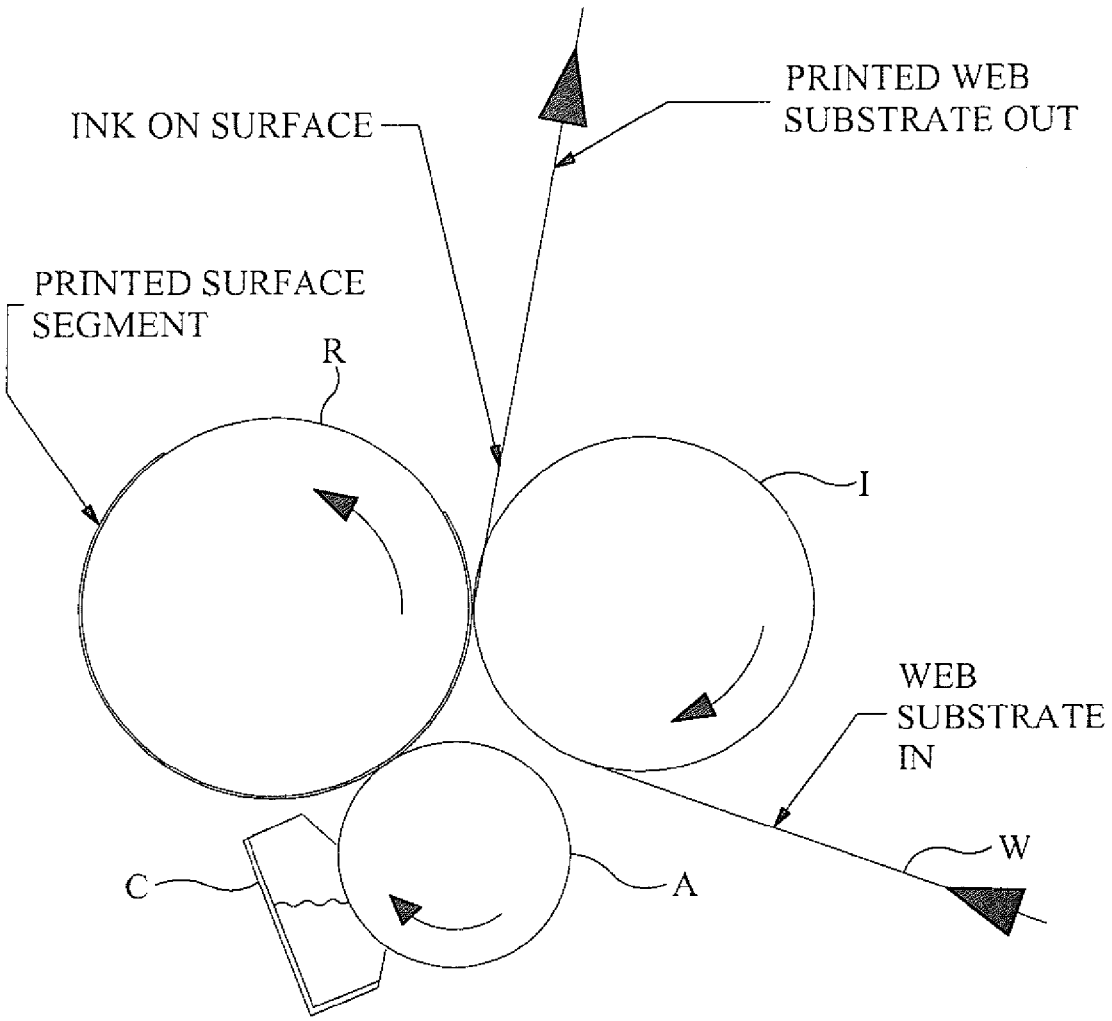
FIG. 1*b* is a cross-sectional view of the printing station as depicted in FIG. 1*a;*
Figure 2A:
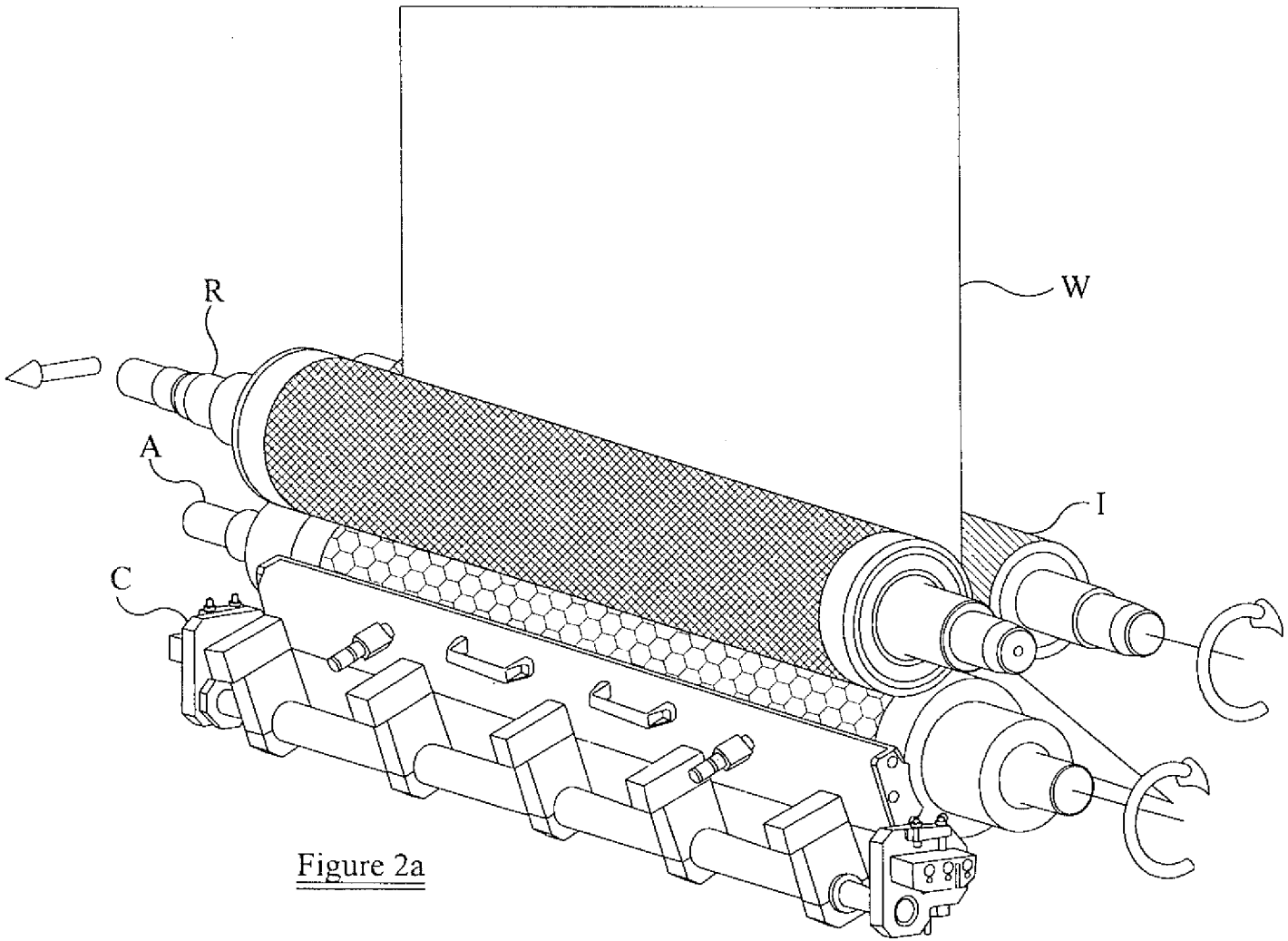
FIG. 2*a* is a perspective view of the printing station as depicted in FIG. 1 in non-printing mode 3.
Figure 2B:
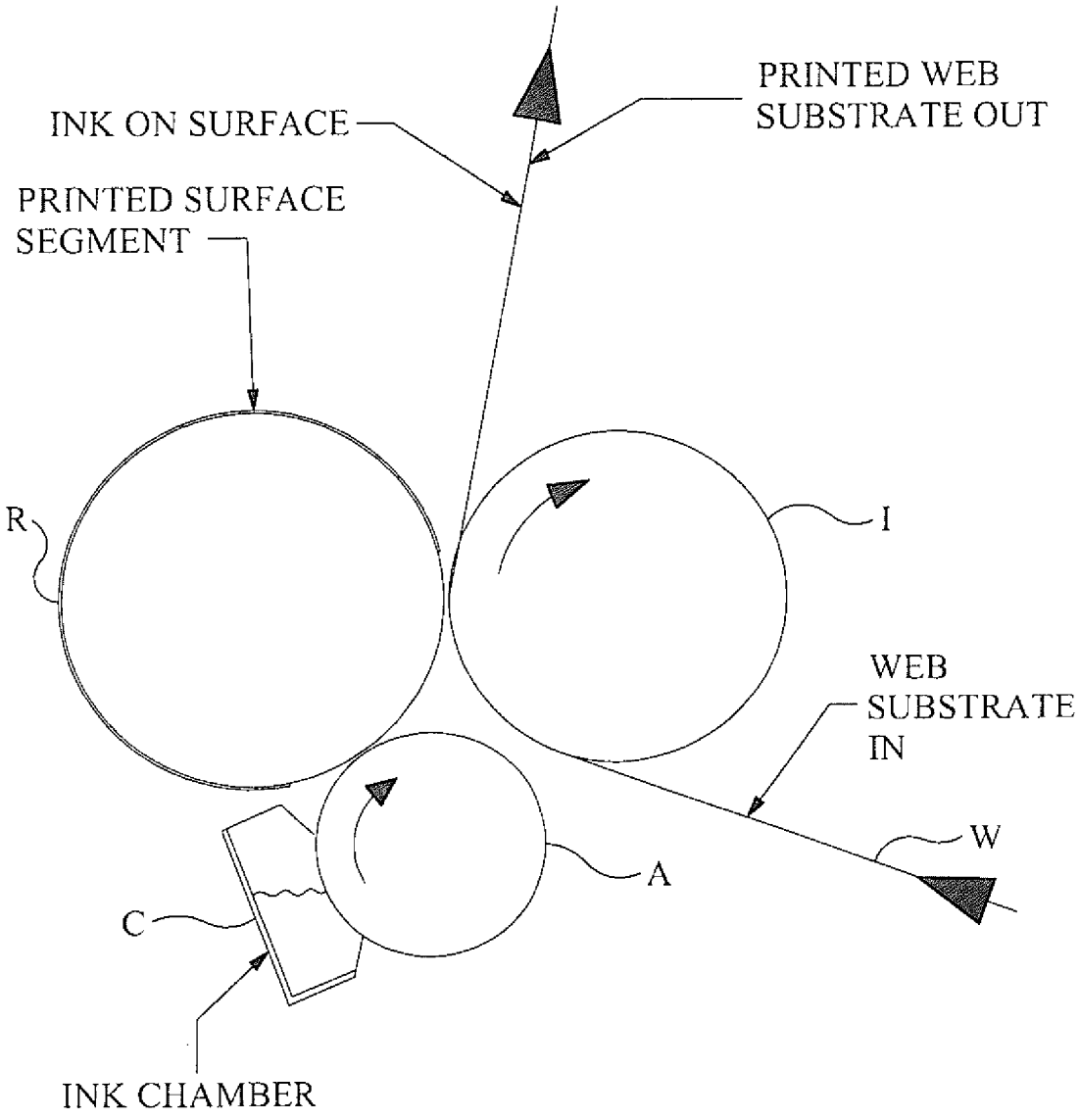
FIG. 2*b* is a cross-sectional view of the printing station as depicted in FIG. 2*a;*

FIGS. 1*a* to 2*b* depict an embodiment of flexographic printing station according to the invention. It can be seen in FIGS. 1*a* to 2*b* that this particular flexographic printing station is an "offset type" of flexographic printing station whereby the printing roller and anilox roller are configured in an offset arrangement. FIGS. 1*a* and lb depict the offset flexographic printing station in printing mode whereby a printed region is formed on a web. FIGS. 2*a* and 2*b* depict the flexographic printing station in a non-printing mode whereby non-printing region is formed on the web.

Figures 3A, 3B:
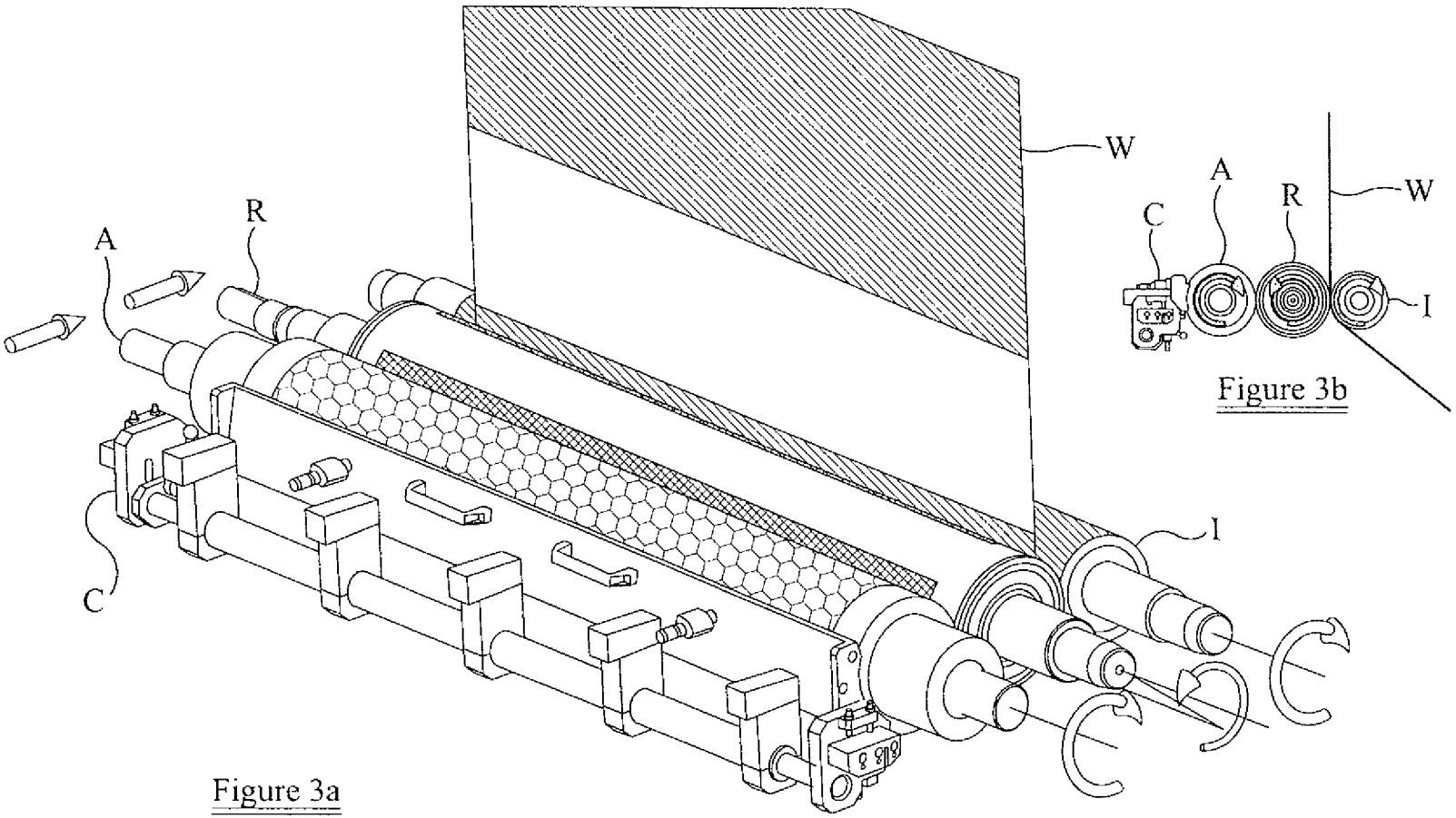
FIG. 3*a* is a perspective view of an embodiment of an online flexographic printing station in printing mode.
FIG. 3*b* is a cross-sectional view of the printing station as depicted in FIG. 3*a;*
Figures 4A, 4B:
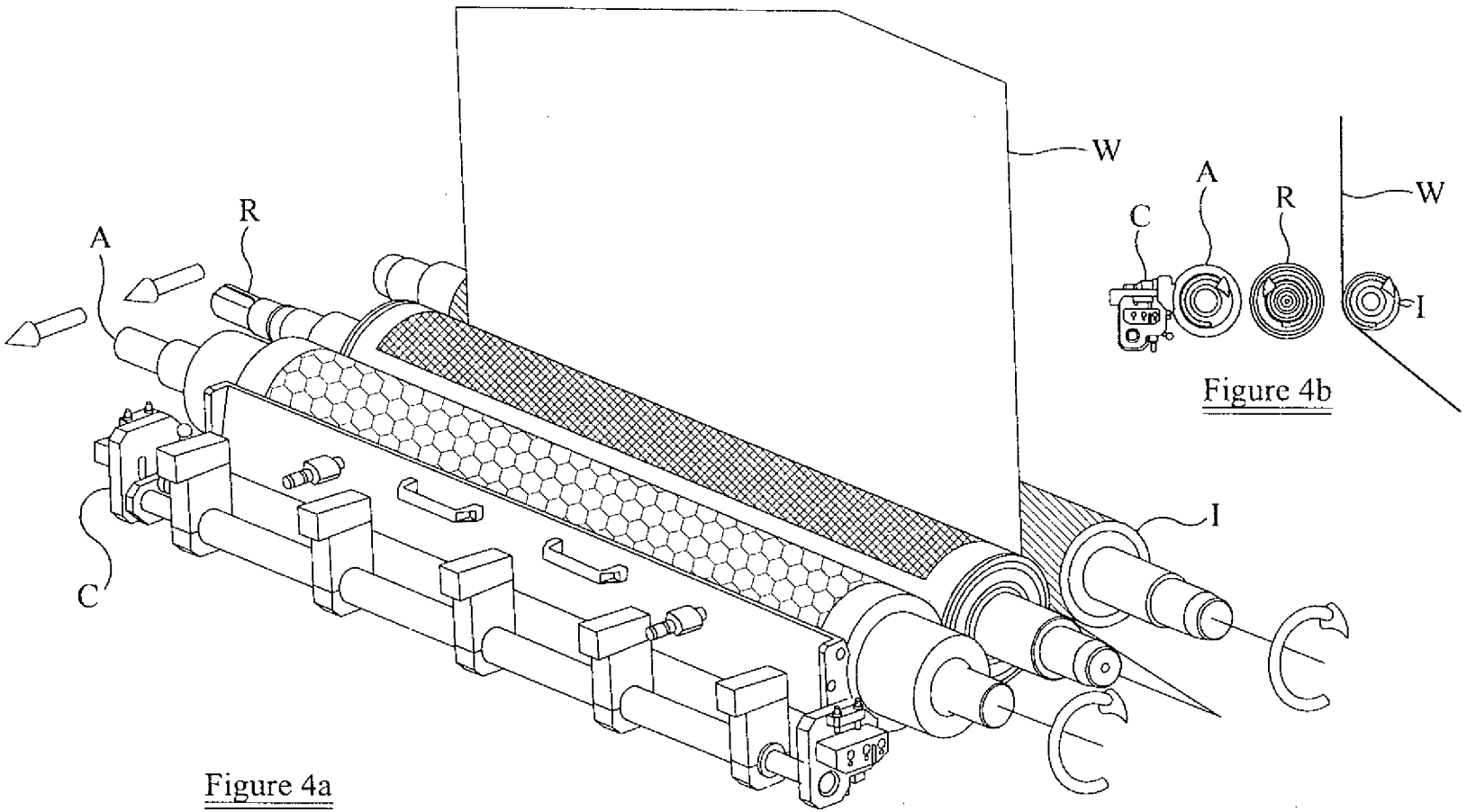
FIG. 4*a* is a perspective view of the printing station as depicted in Figure in non-printing mode.
FIG. 4*b* is a cross-sectional view of the printing station as depicted in FIG. 4*a;*

FIGS. 3*a* to 4*b* depict an embodiment of an "online type" of flexographic printing station according to the invention where the printing roller and anilox roller are configured in a linear arrangement. FIGS. 3*a* and 3*b* depicts the online flexographic printing station in printing mode and FIGS. 4*a* and 4*b* depicts the online flexographic printing station in non-printing mode.

The printing roller (R) is a cylinder having a first end portion and a second end portion. The printing roller may have any circumference size that is suitable for printing an image on a web. For example, the printing roller may have a circumference of 1050 mm, 1350 mm and 2000 mm. Typically, the size of the printing roller that is selected is dependent on the printing purpose and also on the size of image and/or image repeat length required.

The printing roller (R) comprises at least one printing zone and at least one non-printing zone. The at least one printing zone and at least one non-printing zone are arranged on an outer (external) surface of the printing roller. The at least one printing zone and at least one non-printing zone extend at least substantially around the circumference of the printing roller. So as to maximise the printing effect, the at least one printing region and/or at least one non-printing region preferably extend at least substantially across the width of the printing roller in a direction parallel to the longitudinal axis of the printing roller.

The printing roller may comprise a printing plate or sleeve comprising the at least one printing zone and at least one non-printing zone. The printing plate may be circumferentially arranged on a rotatable press cylinder. The printing plate may be integrally formed with the press cylinder. Alternatively, the printing plate may be removably mounted on the press cylinder. The printing plate may be formed from any suitable material such as a rubber material, photosensitive polymer material or metallic material. The printing zone and non-printing zone of a rubber printing plate may be formed from a conventional rubber moulding process. The at least one printing zone and at least one non-printing zone of a photopoylmer plate may be formed by a conventional UV exposure process. The printing zone and non-printing zone of a metallic printing plate may be formed from by a conventional etching process.

The at least one printing zone comprises a relief pattern that corresponds to a desired image to be printed on the web. The relief pattern is a raised, upstanding or protruding pattern area on the outer surface of the printing cylinder. The relief pattern is a mirror image of the image that is printed on the web.

The non-printing zone of the printing roller has a lower profile than the relief pattern of the printing zone. The non-printing region is preferably a substantially flat and non-raised area on the outer surface of the printing roller.

As mentioned above, the anilox roller (A) is provided to transfer ink onto the printing roller. Due to the raised profile of the relief pattern, ink is preferentially applied by the anilox roller to the relief pattern of the at least one printing zone rather than the at least one non-printing zone. During the printing process, the ink is then transferred from the relief pattern to the web so as to form an image. Flexography is deemed to be a relief printing process whereby a relief pattern applies an image on a web.

Figure 5A:
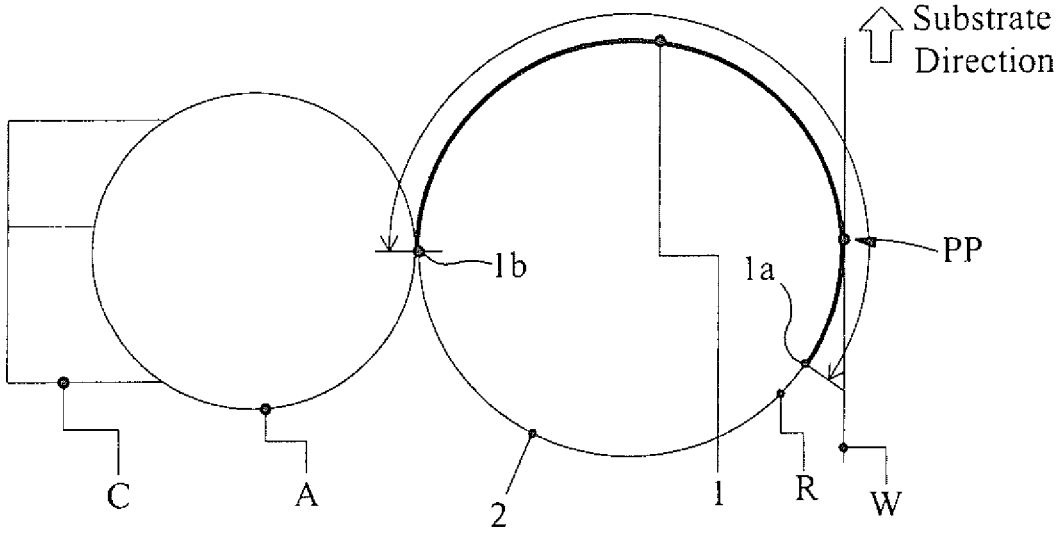
FIG. 5*a* is cross-sectional schematic views showing of a first embodiment of a rotatable printing roller screen according to the invention as it rotates in an anti-clockwise direction.

FIG. 5*a* depicts an embodiment of a printing roller that comprises a single printing zone (1) and a single non-printing zone (2) arranged around the circumference of the printing roller. In this case, the printing zone (1) extends between a first printing point (la) and a second printing point (1*b*) on the circumference of the cylindrical screen. Both the printing zone (1) and the non-printing zone (2) extend across the width of the cylindrical screen. In this particular embodiment, the non-printing zone (2) covers a circumferential arc region of approximately 100 degrees whilst the printing zone (1) covers a circumferential arc region of approximately 260 degrees.

Figure 6A:
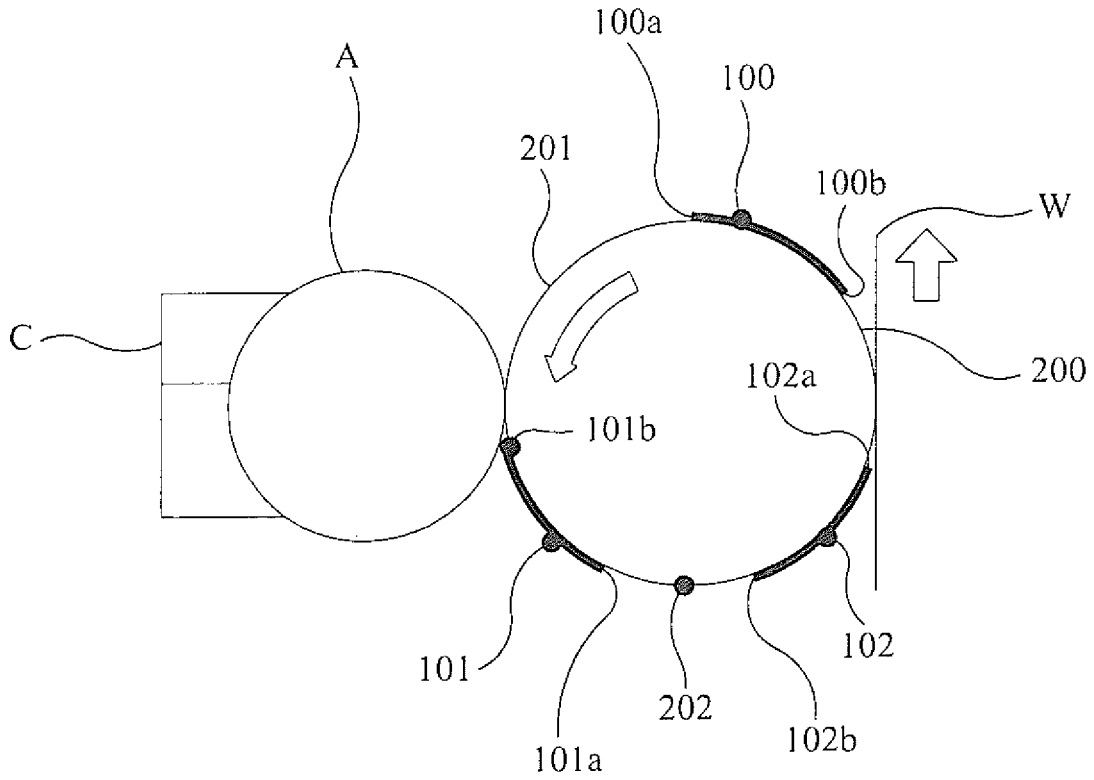
FIG. 6*a* is cross-sectional schematic views showing a second embodiment of a rotatable cylindrical screen according to the invention as it rotates in an anti-clockwise direction.

FIG. 6*a* depicts an embodiment of a printing roller that comprises three printing zones (100, 101, 102) and three non-printing zones (200, 201, 202) arranged sequentially around the circumference of the printing roller. In this case the first printing zone (100) extends between a first printing point (100*a*) and a second printing point (100*b*), the second printing zone (101) extends between a third printing point (101*a*) and a fourth printing point (101*b*) and the third printing zone (102) extends between a fifth printing point (102*a*) and a sixth printing point (102*b*). All the printing zones and non-printing zones extend across the width of the screen. In this particular embodiment all the zones have the same circumferential length and cover a circumferential arc region of about 60 degrees. However in a different embodiment, the circumferential lengths of the printing zones and/or non-printing zones may vary with respect to one another in accordance with the requirements of the final design and control system.

As mentioned above, the at least one printing zone comprises a relief pattern of an image to be printed. The circumferential length of the printing zone is dependent on the size of the image to be printed. In the example where the printing roller comprises a circumference of 1050 mm where the printing zone is 800 mm and the non-printing zone is 250 mm, the relief pattern may be configured to produce an image that is 700 mm long.

The circumferencial length of the non-printing zone is dependent on the size of the image to be printed and also on the dynamic requirements of printing roller, web line means and various control/adjustment means.

Due to the printing and non-printing zones of the screen, a revolution (operating cycle) of the printing roller forms corresponding printed and non-printed regions on the web. It is common in the printing industry to collectively refer to the printed regions and non-printed regions formed during a single revolution (a single operating cycle) of the cylindrical screen as a "repeat" or "image repeat". As the printing roller continues to rotate, multiple image repeats are formed on the web. The distance between a common point of two adjacent image repeats is commonly referred to as a "repeat length" or "image repeat length"

A printed region is formed on the web as the printing roller rotates and a printing zone passes over and the relief pattern forms printing contact with the web. A printed region on the web comprises a printed image that corresponds to the relief pattern of the associated printing zone. The printing roller is deemed to be in a "printing mode" as a printing zone passes over the web.

A non-printed region is formed on the web as the printing roller rotates and a non-printing zone passes over the web. A non-printed region on the web is at least substantially free from ink contamination. The printing roller is deemed to be in a "non-printing mode" as a non-printing zone passes over the web.

To reiterate, since a printing roller comprises at least one printing zone and at least one non-printing zone, a printing roller may undergo at least one printing mode and at least one non-printing mode during an operating cycle (a single complete revolution of the screen). A printing roller comprising only one printing zone will print only one image (printed region) per operating cycle. A printing roller comprising 2, 3, . . . X printing zones will print 2, 3, . . . X images (printed regions) respectively per operating cycle. For the sake of clarity, we shall refer to a repeat made up of multiple printed regions and non-printed regions as comprising multiple "repeat portions" (a printed region and its associated non-printed region) that are separated by a "repeat portion length".

Figure 5B:
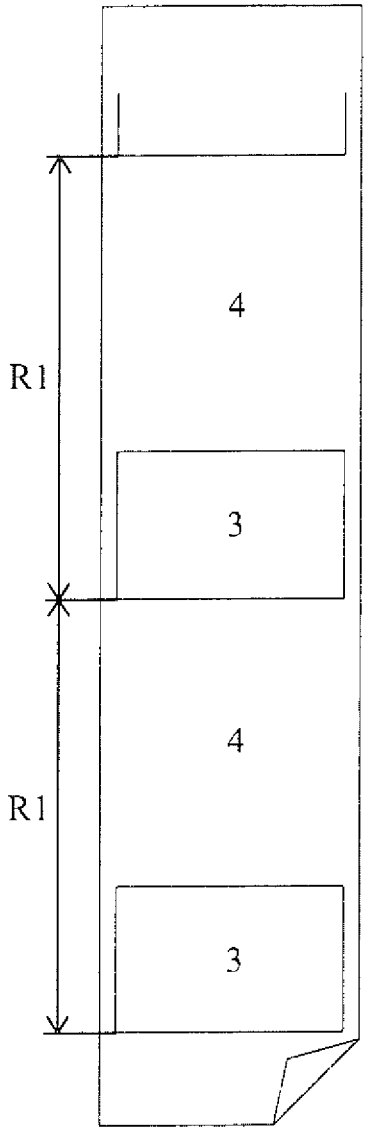
FIG. 5*b* is an extract of a web produced using the printing roller of FIG. 5*a;*

FIG. 5*b* depicts an extract of an example of a web that has been printed using the printing roller depicted in FIG. 5*a*. The web extract comprises two image repeats having an image repeat length R1. Each repeat comprises a printed region (3) (formed as the printing zone (1) passed over the web) and a non-printed region (4) (formed as the non-printing zone (2) passed over the web).

Figure 6B:
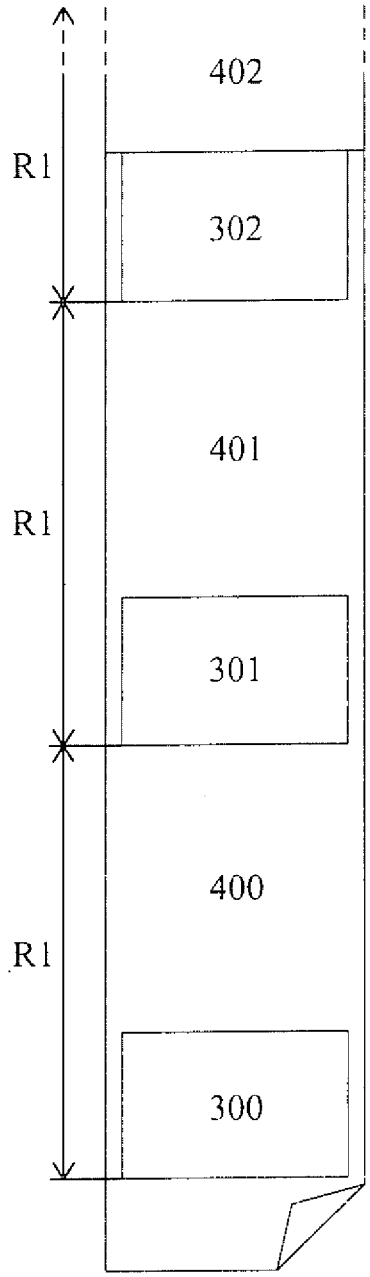
FIG. 6*b* is a view of an extract of a web that has been printed using the printing as depicted in FIG. 6*a;*

FIG. 6*b* depicts an extract of an example of a web that has been printed using the printing roller as depicted in FIG. 6*a*. Since the printing roller screen comprises three printing zones sequentially interspaced by three non-printing zones of the printing roller, the repeat comprises three repeat portions. The distance between each repeat portion is identical, R1. The first printed region (300) was formed as printing zone (100) passed over the web. The first non-printed region (400) was formed as non-printing zone (200) passed over the web. The second printed region (301) was formed as printing zone (101) passed over the web. The second non-printed region (401) was formed as non-printing zone (201) passed over the web. The third printed region (302) was formed as printing zone (102) passed over the web. The third non-printed region (402) was formed as non-printing zone (202) passed over the web.

In operation, the web may be fed to pass over the printing roller in any suitable direction or at any suitable angle. For example, in the embodiments depicted in FIGS. 1*a* to 6 the web is fed in a substantially vertical direction relative to the printing roller. The web may alternatively be fed passed the screen in a substantially horizontal direction or inclined direction relative to printing roller. The web is configured to at least substantially extend across the width of the printing roller.

So as to achieve the best possible printing effect, the printing roller (R) and web (W) are configured so as to be in mating contact or printing contact during the printing mode. More specifically, the printing roller and web are configured such that the relief pattern is in mating contact or printing contact with a printing surface of the web during the printing mode. The point at which the printing surface and relief pattern mate may be referred to as the printing point (PP). Depending on the configuration of the relief pattern, printing point PP may extend along the width of the printing roller.

The printing roller may be permanently mounted such that it remains in the same position relative to the web throughout the printing process (i.e. during both the printing modes and non-printing modes). Likewise, the anilox roller may be permanently mounted such that it remains in the same position relative to the web throughout the printing process (i.e. during both the printing modes and the non-printing modes).

Figure 7A:
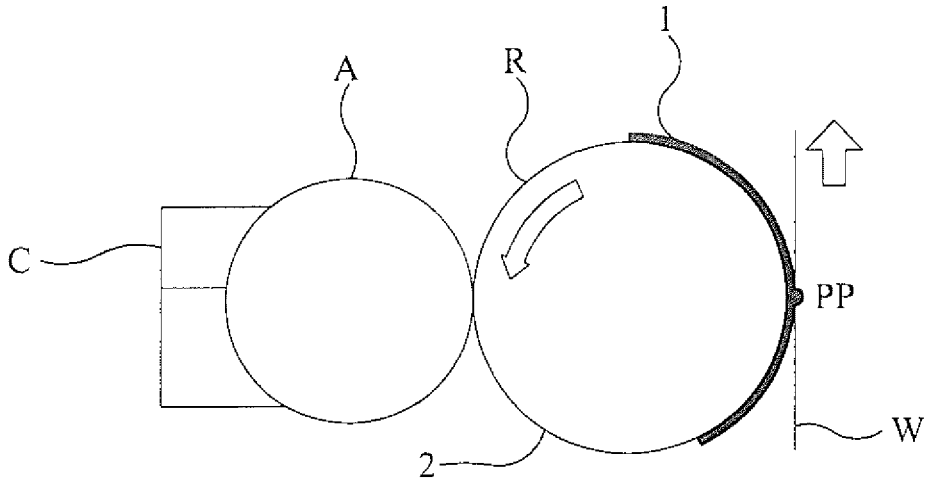
FIGS. 7*a*, 7*b* and 7*c* are cross-sectional schematic view showing how the printing roller rotates printing mode and non-printing mode.
Figure 7B:
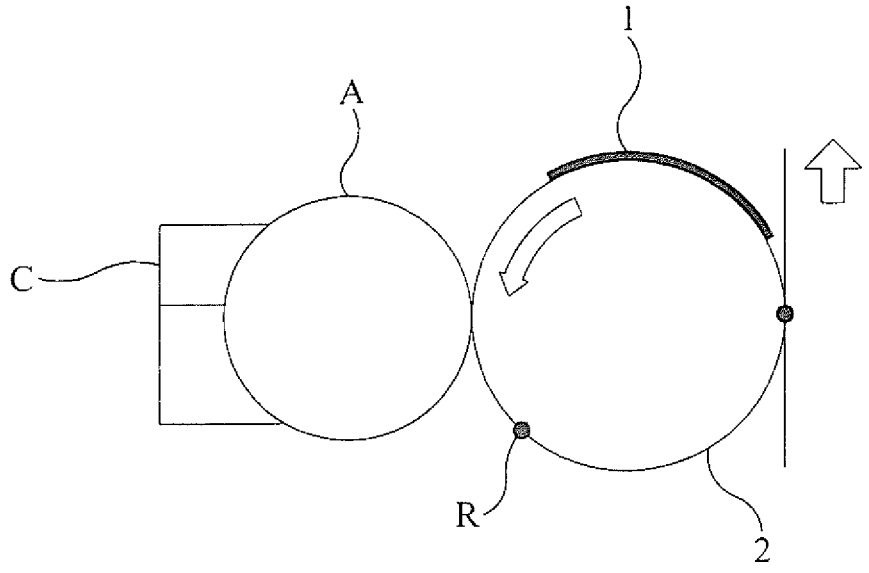

In the embodiment depicted in FIGS. 7*a* and 7*b*, the printing roller (R) is configured to rotate in an anti-clockwise direction. The web (W) is configured to move upwardly relative to the printing roller. FIG. 7*a* shows a part of the printing zone (1) in registration with the web at printing point PP. The printing roller is in printing mode—thus, the relief pattern of the printing zone is in mating contact with the web and ink is being transferred from the relief pattern onto the web so as to print the desired image. FIG. 7*b* shows how the printing roller has been as rotated and the non-printing zone (2) is now in registration with the web. As a result, printing has stopped. During the non-printing mode, the printing roller is in close proximity but not in mating contact with the web due to the low profile of the non-printing zone, and so ink can not be transferred to the web.

In an alternative embodiment, the printing roller may be adjustably mounted such that its position may be adjusted relative to the web during the printing process. The printing roller may be adjustably mounted using adjustable mounting means so as to adjust the position of the printing roller relative to the web. The adjustable mounting means preferably allow for movement of the printing roller in at least two different planes or directions. As a result, the position of the printing roller may be adjusted so as to achieve different printing effects. Also and alternatively, the printing roller may be lifted, raised, retracted or moved away from the web so that it is no longer in mating contact with the web. The printing roller may be retracted when the printing roller is in non-printing mode so as to help keep the non-printed region (that is formed on the web during the non-printing mode) free from ink. The adjustable mounting means may include servo, stepper or linear motors and/or a cam system to adjust the position of the printing roller. The adjustable mounting means are preferably dynamically responsive (i.e. change position quickly) and accurate to ensure the printing action of the printing roller is not compromised.

Alternatively or additionally, the anilox roller may be adjustably mounted such that its position may be adjusted relative to the printing roller during the printing process. The anilox roller may be adjustably mounted using adjustable mounting means so as to adjust the position of the anilox roller relative to the web. The adjustable mounting means preferably allow for movement of the anilox roller in at least two different planes or directions. The anilox roller may be lifted, raised, retracted or moved away from the printing roller so that it is no longer in mating contact with the printing roller. The anilox roller may be retracted when the non-printing zone of the printing roller is registration with the anilox roller so as to help keep the non-printing zone free from ink. Alternatively or additionally, the anilox roller may be retracted when the printing roller is in non-printing mode so as to help ensure the non-printed region (that is formed on the web during the non-printing mode) free from ink. The adjustable mounting means may include servo, stepper or linear motors and/or a cam system to adjust the position of the printing roller. The adjustable mounting means are preferably dynamically responsive (i.e. change position quickly) and accurate to ensure the printing action of the printing roller is not compromised.

Figure 7C:
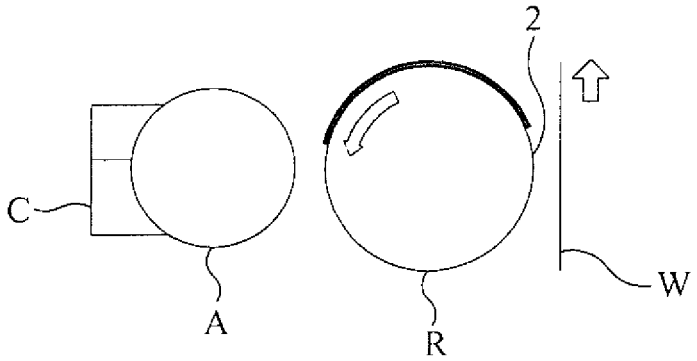

In the embodiment depicted in FIG. 7*c*, the printing roller has been rotated and a non-printing zone (2) is in registration with the web. As a result, printing has stopped and the printing station is in non-printing mode. In this particular embodiment, the printing roller has been retracted away from the web during non-printing mode so as to help ensure no ink is transferred to the web. Moreover, the anilox roller has been retracted away from the printing roller so as to ensure no ink is transferred to the printing roller during the non-printing mode.

Figure 8:
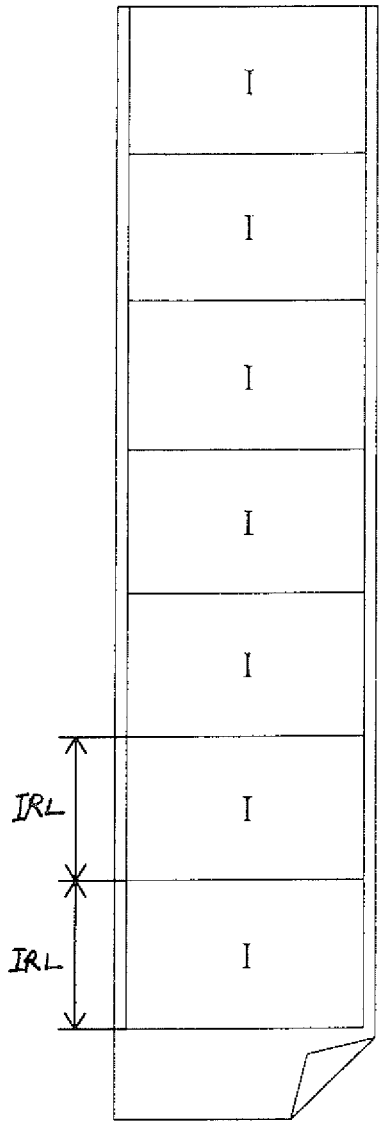
FIG. 8 is a view of an extract of a web that has been printed using a conventional printing station.

As explained above, the rotational speed of the printing roller in a conventional flexographic printing system is at least substantially synchronised with the web line-speed throughout the entire printing process. Hence, image repeat length corresponds to the circumference of printing roller. FIG. 8 shows a part of a printed web under conventional flexographic printing conditions where the rotational speed of the printing roller is at least substantially synchronised with the web line-speed throughout the printing process. An image (I) is repeatedly printed on the web at regular intervals (R). The image repeat lengths (IRL) are identical to the circumference of the printing roller.

However, the present invention provides a printing method and apparatus for printing at least one image repeat whereby the image repeat length is greater than the circumference of the printing roller. According to the invention, an image repeat having an image repeat length that is greater than the circumference can be produced by controlling the rotational speed of the printing roller relative to the web during a non-printing mode such that the non-printed region formed on the web during the non-printing mode is longer than the circumferential length of the associated non-printing zone on the printing roller. The length of the non-printed region on the web may be extended with respect to the associated non-printing zone on the printing roller by slowing or stopping the printing roller with respect to the moving web during the non-printing mode. By slowing or stopping the printing roller with respect to the moving web, a length of web passes over the printing roller such that when the printing recommences, the overall length of the web that has passed during the non-printing mode (the non-printed region on the web) is greater than the associated non-printing zone.

So as to produce an image repeat where the image repeat length is greater than the circumference of the printing roller, the rotation of the printing roller is preferably controlled to follow:

(i) a first motion profile during the printing mode(s) of an operating cycle (i.e. one complete revolution of the printing roller); and (j) a second, different motion profile during the non-printing mode or at least one non-printing mode (if there are a plurality of printing modes during an operating cycle) of the same operating cycle.

Under the first motion profile, the printing roller is rotated at a predetermined printing speed so as to print at least one image on the web. Preferably the printing speed is maintained throughout the first motion profile. Preferably, the printing speed is a rotational speed that is at least substantially synchronised with the web line speed. When this occurs, the length of a printed region on the web is substantially equal to the circumferential length of the associated printing zone.

Moreover, the size of the image printed in the printed region is at least substantially equal to the size of the relief pattern. Alternatively, the predetermined printing speed of the printing roller may be a rotational speed that achieves a slip printing effect. For example, the printing speed of the printing roller may be lower than the nominal printing speed that synchronises with the web line speed so that the resulting printed image is stretched or elongated with respect to the relief pattern. Alternatively, the printing speed may be higher that the nominal printing speed that synchronises with the web line speed so that the resulting printed image may be squat with respect to the relief pattern.

Under the second motion profile, the rotation of the printing roller is controlled such that the length of the non-printed region in the repeat or repeat portion (if there is a plurality of non-printed regions) is longer than the circumferential length of the associated non-printing zone on the printing roller. This may be achieved by:

(i) reducing the rotational speed of the printing roller to a speed below the predetermined printing speed (e.g. substantially reducing the speed to a "creeping" speed) when the non-printing zone is in registration with the web;

(j) or alternatively stopping/suspending the rotation of the printing roller with respect to the moving web when a non-printing zone is in registration with the web.

By extending the length of at least one non-printed region on the web the overall repeat length is greater that the circumference of the printing roller.

Preferably, the printing roller is decelerated or stopped during an initial period of the second motion profile.

As part of the second motion profile, the rotational speed of the printing roller is preferably increased such that the printing roller is rotating at the predetermined printing speed as a subsequent printing zone comes into registration with the web. Accelerating the rotation of the printing roller to printing speed prior to starting printing mode helps to maintain a high printing performance. Preferably, the printing roller is accelerated during the latter period of the second motion profile such that the speed of the printing roller is at least substantially synchronised with the speed of the web a short time before the printing roller enters printing mode.

Under the second motion profile the printing roller may be rotated in a reverse direction, at a predetermined speed, for a given period of time and at a predetermined time during the second motion profile. It has been found that the reverse motion helps to optimise the acceleration of the printing roller back up to the predetermined printing speed.

As explained previously, FIG. 5*c* shows a part of a printed web (W) that has been produced by the embodiment of the printing roller as depicted in FIG. 5*a*. An image in the non-printed regions (3) has been repeatedly printed on the web at regular intervals. The images were formed on the web as the printing zone of the printing roller passed across the web under a first motion profile. Under the first motion profile, the printing roller was rotated at a printing speed that substantially synchronised with the web line speed. The non-printed regions (4) were formed on the web as the associated non-printing zone of the printing roller passed over the web under a second, different motion profile. Under the second motion profile, the rotational speed of the printing roller was initially substantially reduced for a predetermined period of time such that it had a creeping motion with respect to the moving web. During this time, a predetermined amount of web moved across the printing roller. Towards the later part of the second motion profile, the rotation of the printing roller was accelerated such that it was rotating at the printing speed when printing mode started again (as the printing zone came back into registration with the web). Due to the second motion profile, the non-printed regions (4) are longer than the circumferential length of the non-printing zone (2) of the printing roller. Hence, the repeat length (R1) is greater than the circumference of the printing roller.

The second motion profile of the printing roller is dependent on the required length of the non-printed region. This, in turn, is dependent on the printing technique being utilised and the nature of the design being printed. Under the second motion profile, the rotation of the printing roller may be controlled so as to achieve any desired image repeat length or repeat portion length. By controlling the rotation of printing roller during the non-printing mode (e.g. controlling the time intervals between slowing/suspending rotation and recommencing rotation and/or by controlling the variation in the rotational speed during the non-printing mode) it may be possible to print a web where the repeats/repeat portions have at least substantially identical repeat lengths/repeat portion length, variable repeat lengths/repeat portion lengths or random repeat lengths/repeat portion lengths.

By controlling the rotation of the printing roller as described a flexographic printing system comprising a plurality of flexographic printing stations according to the invention can implement different printing techniques that may be suitable for producing designs having a large size format, multiple images having large separations.

Further information relating to the effects, advantages and different types of printing techniques that may be achieved by controlling the rotation of the printing roller such that the repeat length is greater than the circumference of the printing roller is provided in more detail below.

A flexographic printing station comprises an ink delivery means to deliver or supply ink to the printing roller. The ink delivery means is suitable for supplying any ink-like fluid that is suitable for flexographic printing purposes. The ink delivery means comprises an anilox roller (A) and an ink chamber (C) comprising any suitable flexographic ink. The anilox roller is configured to transfer ink to the relief pattern during the inking process. The anilox roller is configured to supply ink across at least the width of the relief pattern of the printing roller. The anilox roller is mounted in a direction parallel to the longitudinal axis of the printing roller. So as to achieve the best possible inking process, the anilox roller is mounted with respect to the printing roller such that it forms a mating contact or "inking contact" with the relief pattern as the printing zone passes over the anilox roller. The point at which the anilox roller and printing roller mate is referred to as the inking point. The inking point extends at least along the width of the relief pattern. The anilox roller is a rotatable cylinder having a first end portion and a second end portion. The anilox roller comprises ink retaining means. The ink transferring means may comprise cells or wells configured to retain a predetermined quantity of ink. The cells or well may be formed in an outer surface of the anilox roller. The ink retaining means are configured so as to uniformly transfer a specific amount of ink to the printing roller.

In the embodiments depicted in FIGS. 1*a*-4*b*, the anilox roller is at least partially submerged in the ink of the ink chamber such that ink may be directly transferred to the anilox roller. In an alternative embodiment, the ink deliver means may further comprise a fountain roller to transfer ink from the ink chamber to the anilox roller. The fountain roller is arranged between the ink chamber and the anilox roller. The fountain roller is partially submerged in the ink of the ink chamber and in mating contact with the anilox roller. Hence, ink may be transferred from the ink chamber and to the anilox roller as the fountain roller is rotated.

The flexographic printing station may comprise ink regulating means so as to avoid an excessive transfer of ink to the printing roller and thereby regulate printing quality. The ink regulating means may comprise a scraper or blade comprising an edge arranged in mating contact along the length of anilox roller. The blade is configured to remove any excess ink from the anilox roller prior to inking the relief pattern.

The flexographic printing station preferably comprises an impression roller. The impression roller is configured to provide a surface to appropriately support the web during the printing process. The impression roller is configured such that the web is impressed against the outer surface of the impression roller by the printing roller as the image is printed on the web. The impression roller is provided so as to maintain a high printing quality.

The impression roller (IR) is preferably a cylinder having a first end portion and a second end portion. The impression roller is arranged in opposing association with the printing roller (R) whereby the longitudinal axis of the impression roller extends in a direction parallel to the longitudinal axis of the printing roller. It can be seen from the embodiments depicted in FIGS. 1*a* to 4*a* that the web line means drive the web between the printing roller and the impression roller.

The printing roller is preferably relatively low weight so that it is possible to design a drive system which is very accurate but of low power. In a preferred implementation, separate motors drive the two ends of the printing roller so as to eliminate twist between the ends (which could lead to screen breakage). By using separate motors along timing pulleys and belts (rather than gears) to drive each end of the printing roller this drive system also gives an improved print register, it minimises the stress on the printing roller during the printing mode and non-printing mode operating cycle, it reduces the costs of the printing station due to the elimination of idler-gears and cross-shaft etc., it is easy to assemble, it improves the allowable printing rate (for example, to approximately 80 m per min), and is quieter to operate.

In the embodiments depicted in FIGS. 1*a*-4*a*, the drive system preferably comprises a first drive means to drive the first end of the printing roller and a second drive means to drive the second end of the printing roller. The drive system further comprises control means to synchronise the driving action of the first drive means and the second drive means and control the rotational speed of the printing roller during the operational cycle. More particularly, the control means controls the rotational speed of the printing roller such that the image repeat length of the repeat is longer than the circumference of the screen. Even more particularly, the control means controls the rotational speed of the printing roller such that the screen follows a first motion profile during a printing mode so as to print an image on the web and a second different motion profile during a non-printing mode such that the image repeat length is longer than the circumference of the printing roller.

As explained previously, under the first motion profile, the rotation of the printing roller is controlled so that the printing roller rotates at a predetermined printing speed to print at least one image on the web. Preferably the predetermined printing speed is maintained throughout the first motion profile. Preferably, the predetermined printing speed is a rotational speed that is at least substantially synchronised with the web line speed. When this occurs, the length of a printed region on the web is substantially equal to the circumferential length of the associated printing zone. Moreover, the size of the image printed in the printed region is at least substantially equal to the size of the relief pattern. Alternatively, the predetermined printing speed of the printing roller may be a rotational speed that achieves a slip printing effect. For example, the printing speed of the printing roller may be lower than the nominal printing speed that synchronises with the web line speed so that resulting printed image is stretched or elongated with respect to the relief pattern. Alternatively, the printing speed may be higher that the nominal printing speed that synchronises with the web line speed so that the resulting printed image may be squat with respect to the relief pattern.

As explained previously, under the second motion profile, the rotation of the printing roller is controlled such that the length of the non-printed region in a repeat or at least one repeat portion (in the case when there is plurality of non-printed regions on the screen) is longer than the circumferential length of the associated non-printing zone on the printing roller. This may be achieved by:—

(i) reducing the rotational speed of the printing roller to a predetermined reduced speed below the predetermined printing speed (e.g. to a "creeping" speed), for a predetermined period of time, when a non-printing zone is in registration with the moving web; or (i) stopping or suspending the rotation of the printing roller with respect to the moving web for a predetermined period of time when a non-printing zone is in registration with the web.

Preferably, the rotation of the printing roller is controlled such that it is decelerated or stopped during an initial period part of the second motion profile.

So as to ensure the image is appropriately printed during the subsequent printing mode, it is preferable to control the motion of the printing roller such that it is already rotating at the predetermined printing speed prior to starting the printing mode. This is achieved by increasing the rotational speed to the predetermined printing speed during a later period of the second motion profile. Optionally, motion of the printing roller may be controlled to undergo a small reversal of rotation (for a predetermined period of time, at a predetermined speed and at a predetermined time during the second motion profile) so as to help optimise the acceleration of the printing roller to the predetermined printing speed.

The rotary printing station comprises a web line means to feed a web through the station and past the printing roller. In the embodiment depicted in FIGS. 1*a*-4*a*, the web line means comprises a roller to support and guide the web along a printing track relative to the screen.

Figure 9B:
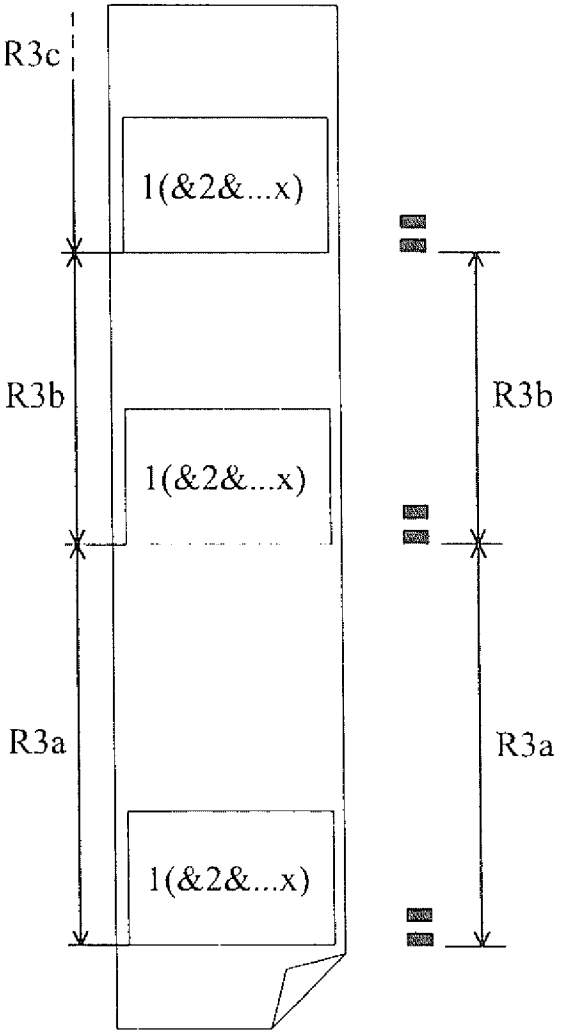
FIGS. 9*a* and 9*b* depict extracts of two webs that have been "marked" so as to accurately align a printing zone of the screen with respect to a desired printing region on the web.
Figure 9A:
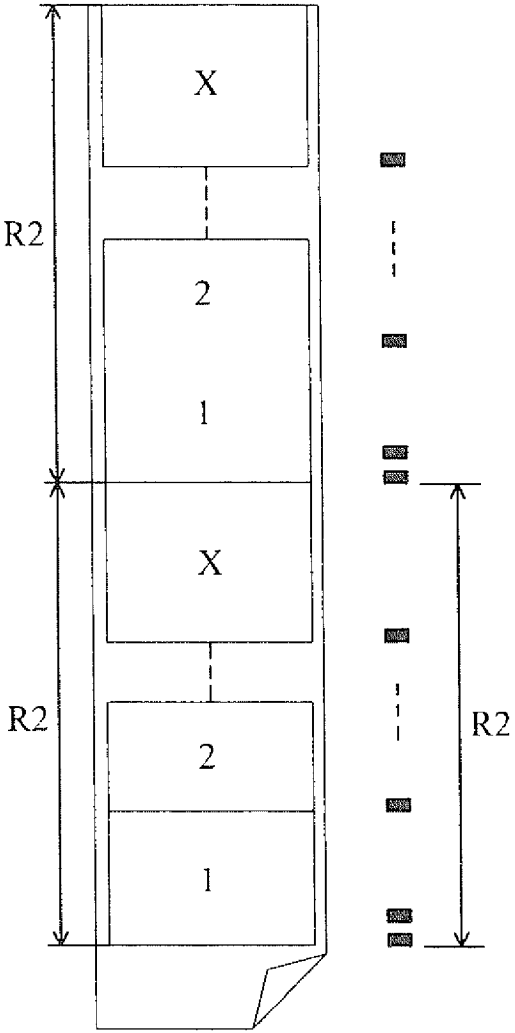

The rotary printing station may comprise an automatic registration system so as to register the position of the web relative to the rotational position of the printing roller. Preferably, the automatic registration system is a "key-mark" registration system where a small mark (or marks) is printed/etched on the web within the trim area. Preferably, the mark is printed on the rear, under-surface of the web so as to maximise contrast and enhance printing performance. The mark may be ink-jet printed on the web by ink-jet printing means. A photo-sensor is incorporated to detect the mark. If required, control means (e.g. drive control means) will initiate a phase adjustment of the printing roller in order to bring the image to be printed into registration with the mark. Alternative systems control also register by reference to previously printed marks. However, in the present invention utilisation of such a system would lead to reduced overall registration performance and be difficult to implement. This is because the previously printed marks only occur once every image repeat. Under the present invention, marks may be printed at any spacings as required by the design, for example at any desired printed region. As a result, multiple images can be printed more accurately on a web. For example, due to this improved registration system, a continuous series of images may be sequentially and accurately printed on a web without any substantial registration problems. Moreover, if a half drop design is required where a design extends horizontally across a wall, images printed on a first web may be matched or aligned more accurately to the corresponding images on the second web. In the web depicted in FIG. 9*a*, the repeat comprises a printed region 1 and then, in the non-printed region associated with region 1, a series of sequentially printed images in printed regions 2 . . . X. For ease, the registration marks printed on the underside of the web are depicted along side the web. It can be seen that a mark is printed adjacent each printed region so as to indicate where each printing zone (1, 2 . . . X) must be located. Hence, each printed region is accurately aligned and positioned with respect to the previous printed region so as to form a continuous series of images. A different mark is printed to indicate the first printed region of the repeat. In the web depicted in FIG. 9*b*, where the repeat comprises a series of overlaid printed images 1, 2, . . . X in a single printed region and a non-printed region, a mark is printed to indicate the location of the printed region. Due to the marks, each image is accurately overlaid with respect to the previous image. It can be seen in FIG. 9*a* that the image repeat lengths R1 and R2 of the web are identical whereas in FIG. 9*b* the image repeat lengths R3*a* and R3*b* are variable. By utilising the key mark registration system as described the rotary printing station according to the invention has a registration of +/−0.25 mm.

Another aspect the invention relates to a flexographic printing system comprising a plurality of flexographic printing stations, whereby at least one flexographic printing station is flexographic printing station as described above. A plurality of flexographic printing stations may be arranged in tandem so as to consecutively feed a web to each of the printing stations so as to print a design comprising multiple images (e.g. images have different shapes and/or colours). This type of printing system further comprises means for transferring the web to the different print stations.

In preferred embodiments of a system comprising a plurality of printing stations whereby all the printing rollers of the stations are electronically geared to an electronic line shaft (a master controller). The electronic line shaft gives close control of the speed and angular positions of the printing rollers in each printing station. Hence, the printing rollers are dynamically responsive, run smoothly and are accurately synchronised with respect to one another. The drive signals generated by the electronic line shaft are preferably implemented using a high speed communications network. Manipulation of the printing rollers by the electronic line shaft allows for multiple image/multiple colour printing techniques as described above. Additionally, the use of electronic line technology enables improved accuracy print registration and allows for simple integration of automatic register control systems for further improvement.

The electronic line shaft effectively replaces the common mechanical line shaft where each drive system runs in a geared synchronous relationship with a master. In the present invention, a master oscillator circuit may be provided to implement the modulation of the electronic line shaft or alternatively, this may be achieved by software at a drive control means.

Examples of different printing techniques and effects that can be achieved by controlling the rotation of the printing roller such that the image repeat length is greater than the circumference of the screen shall now be described.

Figure 10A:
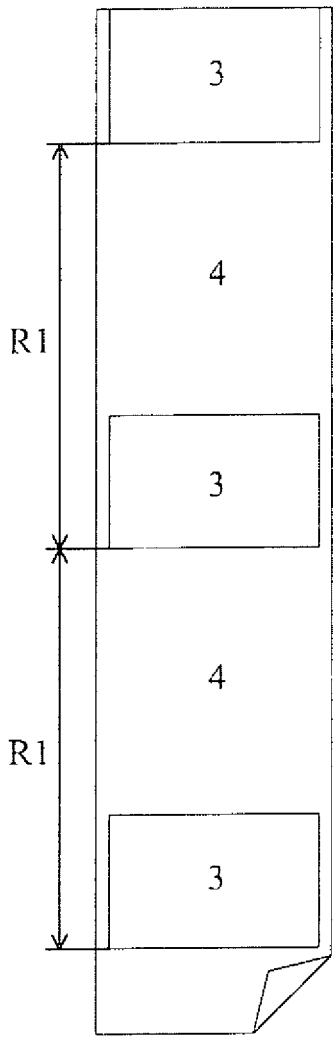
FIGS. 10*a* to 20*c* depict extracts from webs showing examples of different print designs and techniques that are achievable using the present invention.
Figure 10B:
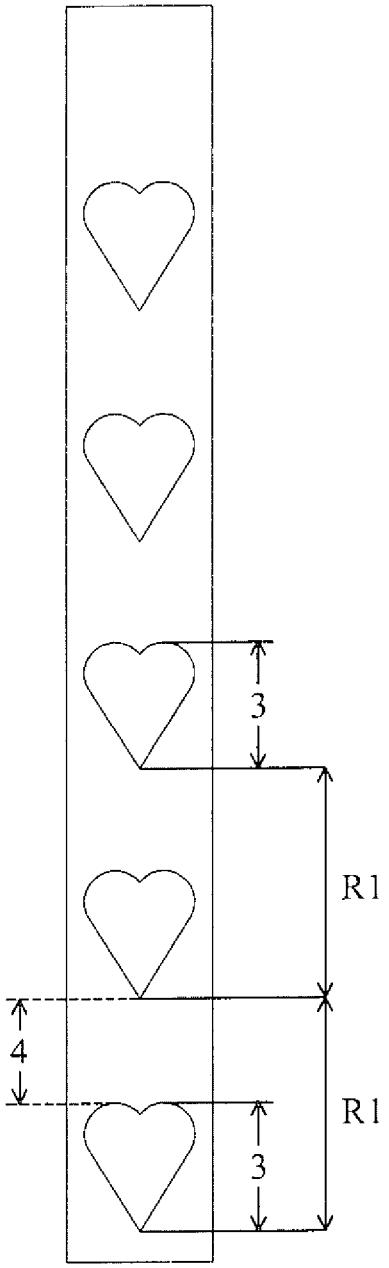

FIGS. 10*a* and 10*b* depict an example of a web having a fixed repeat design—that is, design comprising a plurality of repeats where the repeat length is fixed to a predetermined value that is greater than the circumference of the printing roller. In this case, the image repeatedly printed on the web at regular intervals is a love heart. This web has been printed using a printing roller having a single printing zone and a single non-printing zone (as shown in FIG. 5*a*). The rotation of the printing roller has been controlled so as to produce a series of consecutive repeats, whereby each repeat comprises a printed region (3) and a non-printed region (4). The image repeat length R1 is greater than the circumference of the printing roller. The rotation of the printing roller has been controlled to ensure the repeat length of each repeat is a least substantially similar.

Figure 11A:
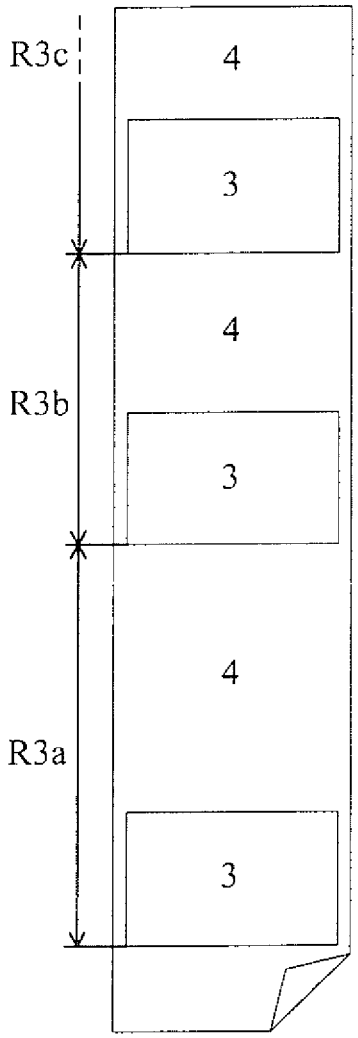
Figure 11B:
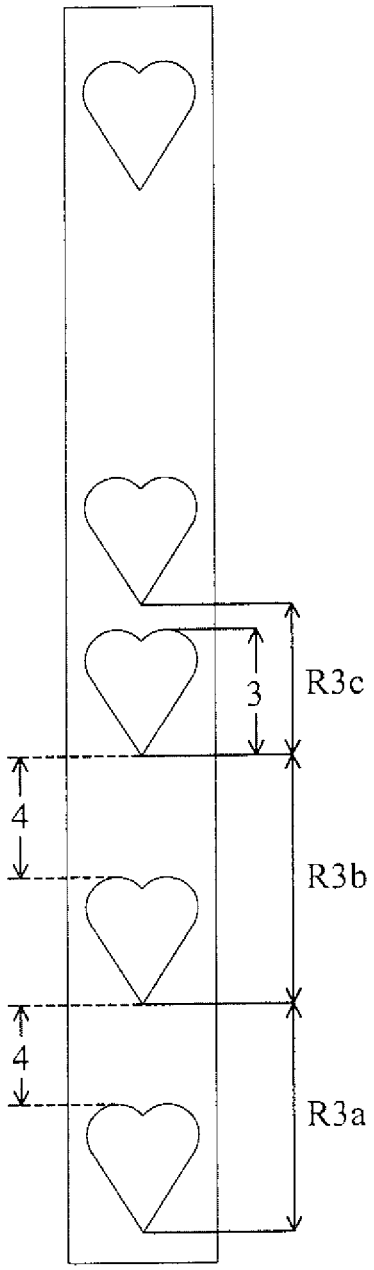

FIGS. 11*a* and 11*b* depict an example of a web having a variable repeat design—that is a design comprising a plurality of repeats where the repeat length varies. In this case, the image repeatedly printed on the web, but arranged at various intervals, is a love heart. This web has been printed using a single printing roller having a single printing zone and a single non-printing zone (as shown in FIG. 5*a*). The rotation of the printing roller has been controlled so as to produce a series of repeats, whereby each repeat comprises a printed region (3) and a non-printed region (4). The rotation of the printing roller has also been controlled to vary the length of each non-printed region so as to provide different repeat lengths (R3*a*, R3*b*, R3*c* etc.) for every repeat. Moreover, the rotation of the printing roller has been controlled so that certain repeat lengths have a repeat length that is longer than the circumference of the printing roller.

Figure 12A:
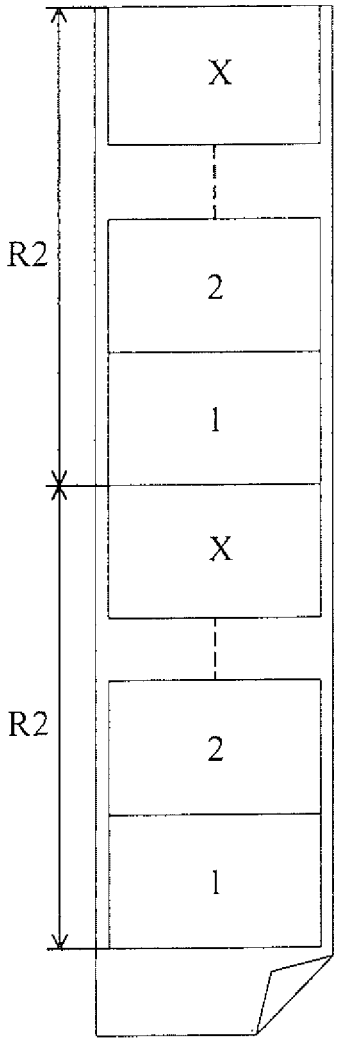
Figure 12B:
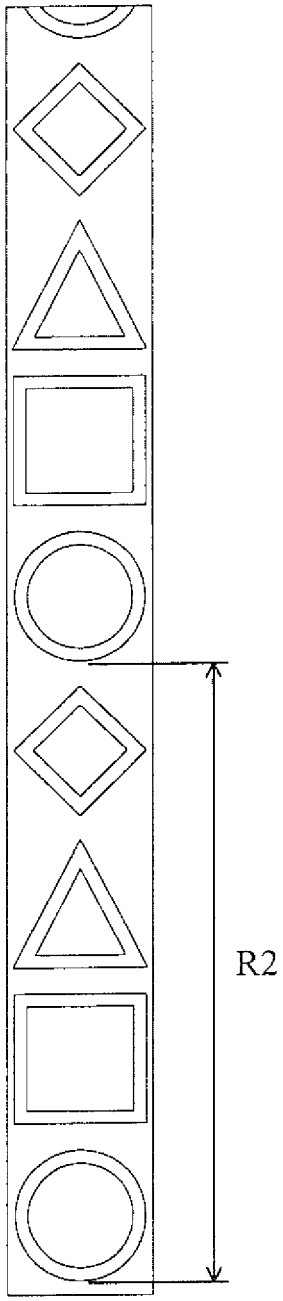

FIGS. 12*a* and 12*b* depict an example of a web having a design comprising a repeating series of multiple (four) images—that is, a design comprising a plurality of repeats where the repeat length of the circle image is large enough to allow a series of three other images (e.g. square, triangle and diamond) to be printed in the non-printed region of the first repeat (e.g. circle). The repeat length for each different image is fixed and it is greater than the circumference of the printing roller. This web has been printed using four different printing rollers. Each of the four printing rollers has a single printing zone and a single non-printing zone and prints a different image (e.g. a circle, a square, a triangle and a diamond). The rotation of each printing roller has been controlled so as to produce a continuous series of repeats in which each of the printed regions follow consecutively 1, 2, 3, 4. The overall repeat length of the repeating series of four images is R2.

Figure 13A:
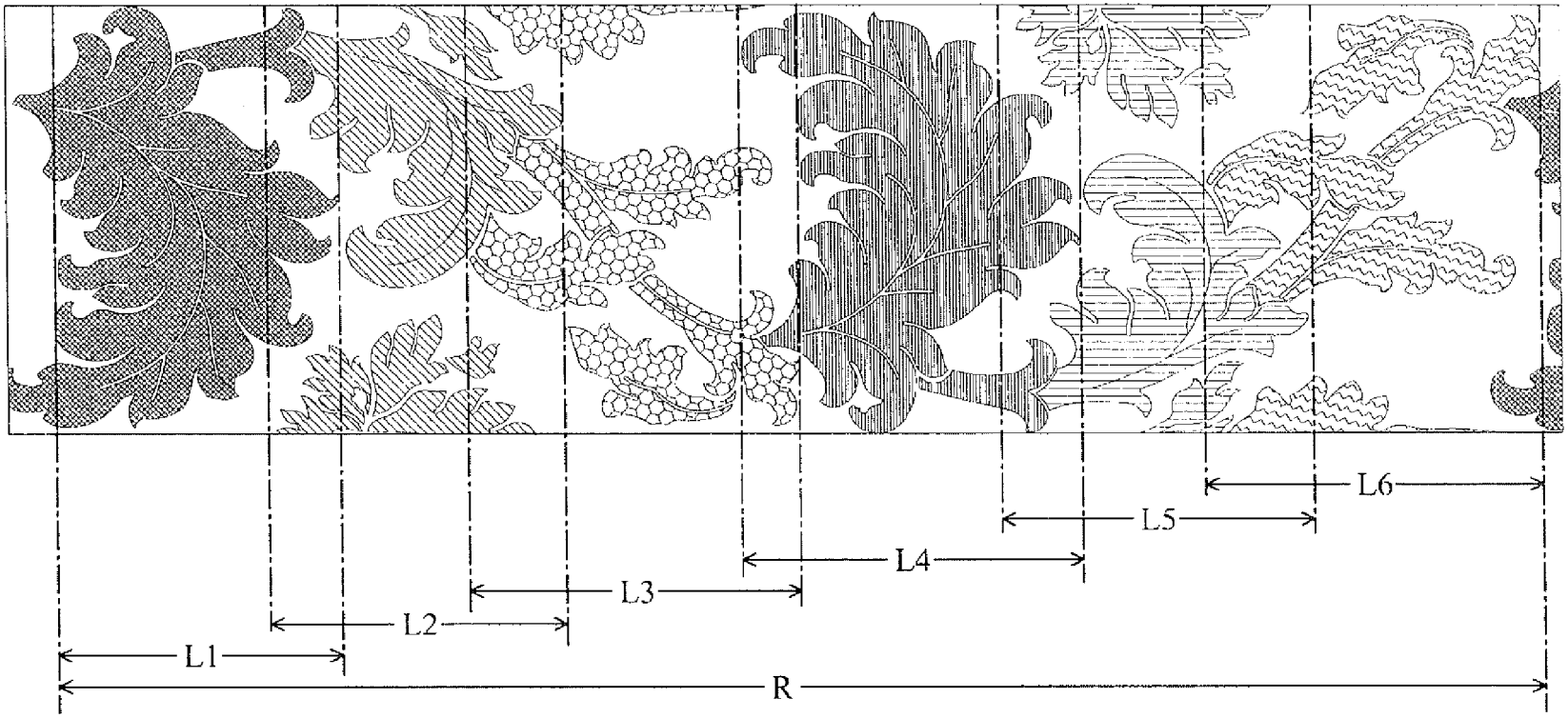
Figure 13B:
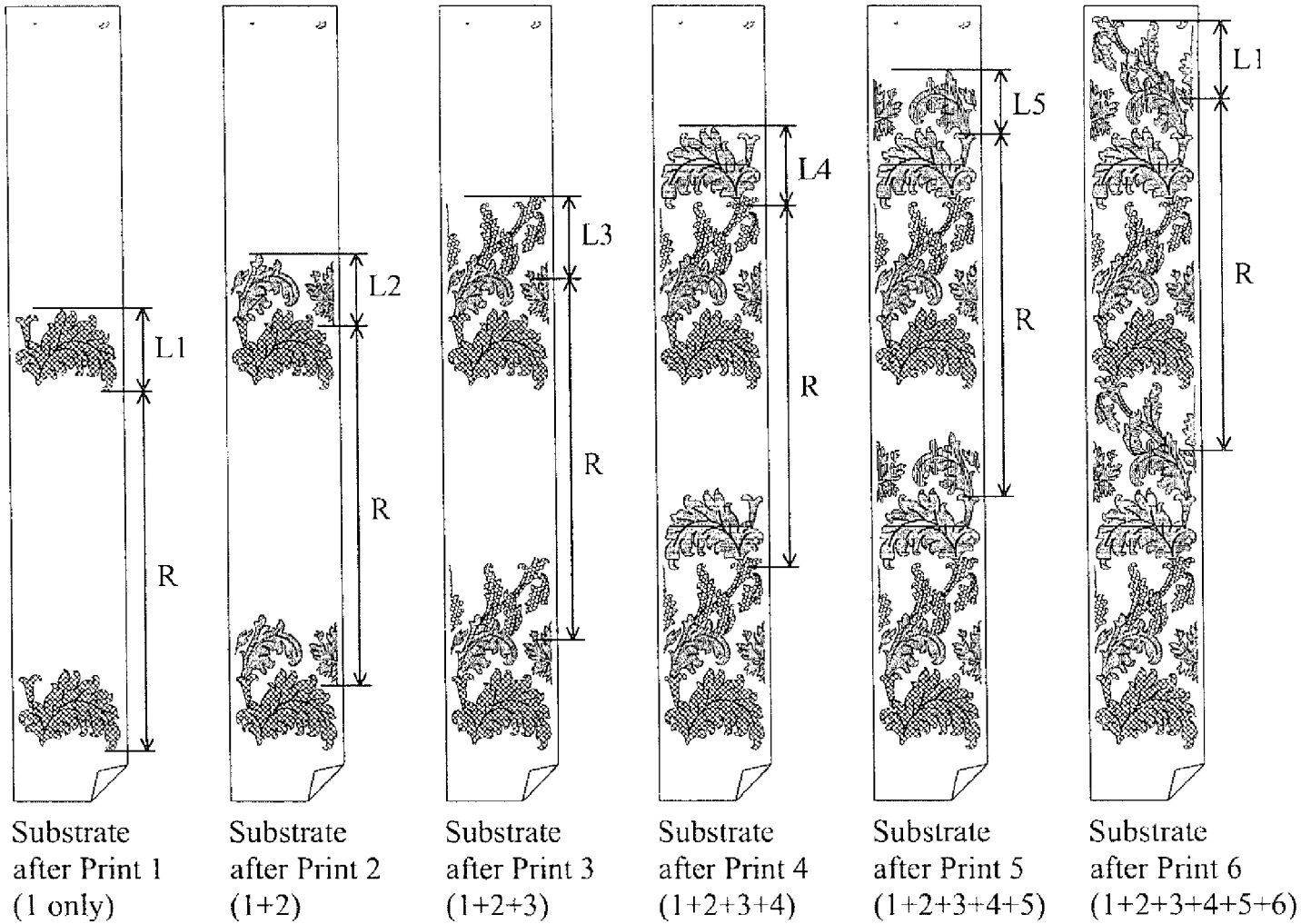

This type of printing technique is further illustrated by the webs depicted in FIGS. 13*a* and 13*b*. Here the web has been printed by six different printing rollers whereby each printing roller prints a different leaf image (L1-L6). The repeat length for each different image is fixed (R) and it is greater than the circumference of the printing roller. It can be seen clearly in 13*b* how the leaf design is sequentially built up by printing each image in turn. It is critical that each leaf image is accurately aligned with respect the previous leaf image. Therefore each image is accurately registered using the key mark registration system so as to ensure best possible printing performance.

Figure 14:
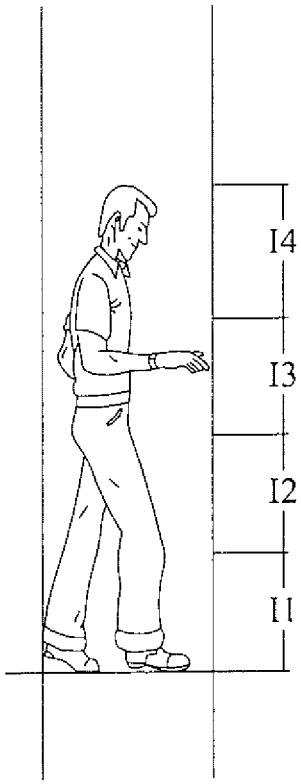

FIG. 14 depicts another example of printing a series of consecutive images to form a design. In this case, four different printing rollers have been used sequentially to systematically build up the design of the man. By using the key mark registration system the four different images (I1, I2, I3, I4) are accurately aligned so as to provide a good quality design, Each of the printed regions of each repeat are at least substantially the same in length. By sequentially building up the images of the design a substantially wall height design may be produced.

Figure 15B:
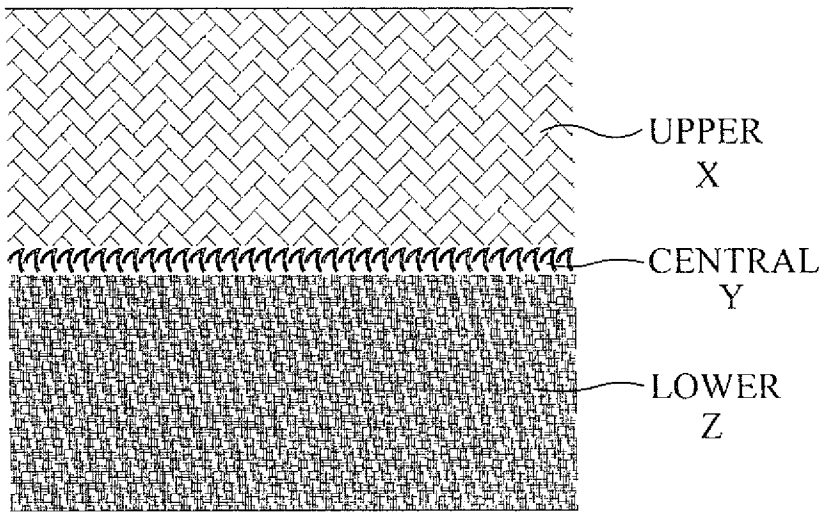
Figure 15A:
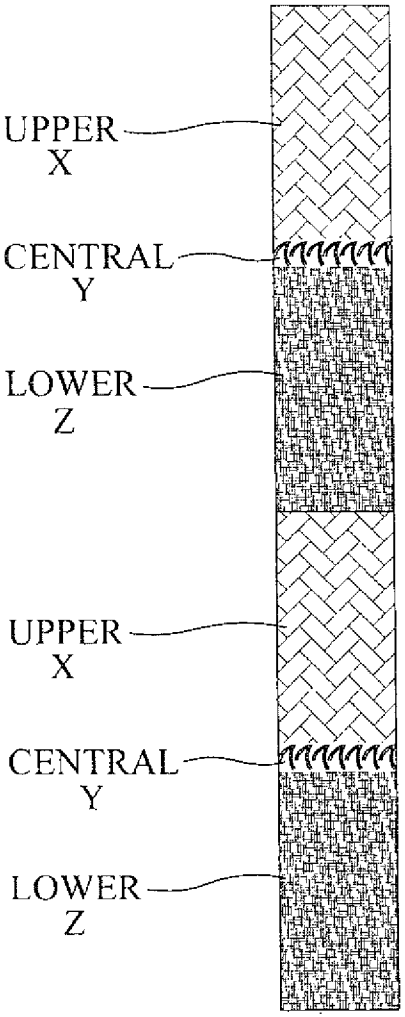

FIG. 15*a* depicts a continuous web that has been printed to include a design with a central border section. The web has been printed using three different printing rollers whereby each printing roller prints a different image. The images have a different size of printed region and different pattern image. In the Figures, the design comprises an upper image (X), central image (Y) and lower image (Z). The three different images are sequentially printed with no gap space there between. FIG. 15*b* depicts the mural effect to the design. This design may be suitable as wall covering to where a central border region is desirable.

Figure 16A:
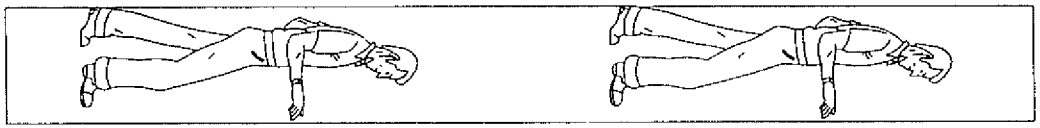
Figure 16B:
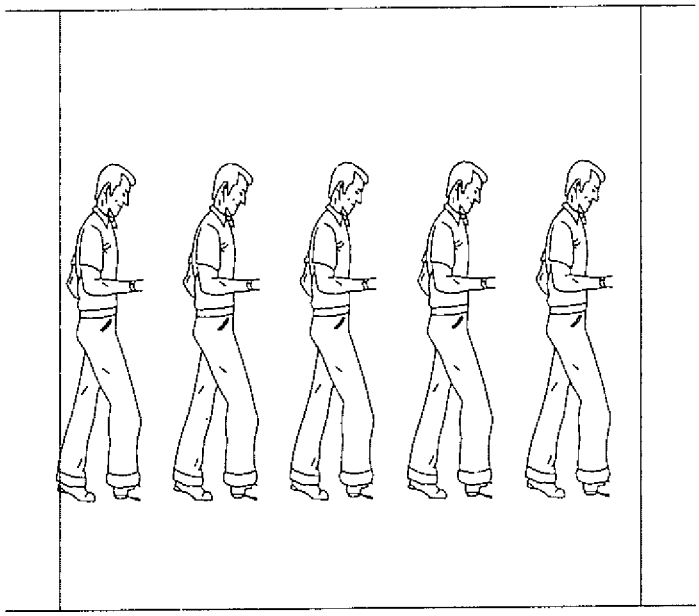

FIG. 16*a* depicts a continuous web that has been repeatedly printed by the four different printing rollers to produce at least two images of the man. The images have been formed as described with respect to FIG. 14. FIG. 16*b* depicts how sections of the continuous web may be cut and pasted on a wall to provide a full wall height mural effect.

Figure 17:
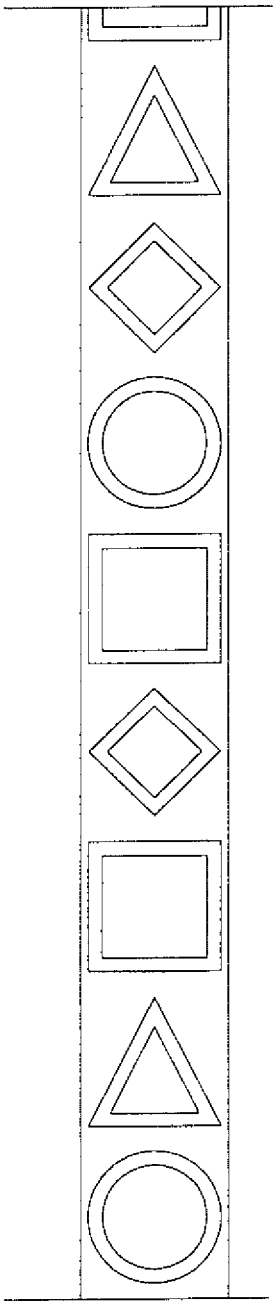

FIG. 17 depicts a random pattern. A random design may be created by randomly selecting different images from plurality of different printing rollers. In FIG. 17, the length of the printed regions is fixed. However, since the repeat length is variable the random printing options are available. In another embodiment series of random images are repeatedly printed on the web. A series of further random images are printed over the initial images. The sections of the continuous web may be cut and pasted on a wall to provide a full wall height mural effect.

Figure 18B:
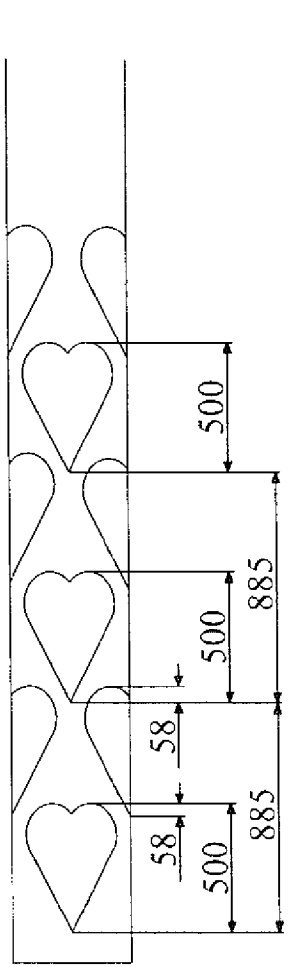
Figure 18C:
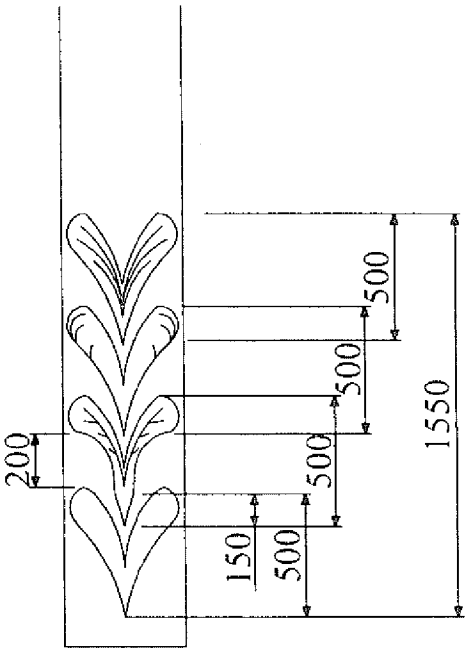
Figure 18A:
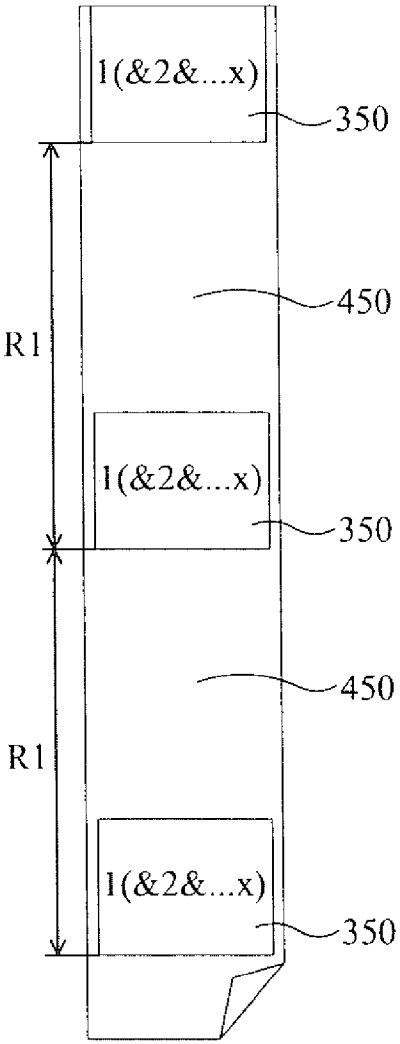

FIGS. 18*a* to 18*c* depicts a web where a plurality of images have been overlaid or staggered with respect to one another. In FIG. 18*a*, X printing rollers print a different image in the same printed region (350). The resulting design comprises a plurality of overlaid images. This effect is achieved by controlling the rotation of the printing rollers such that they always initiate printing mode on the same location of the web, they also have the same image repeat lengths (R1). FIG. 18*b* depicts a web where love heart images have been printed on a web in an over-laying, staggered manner. This may be achieved by printing an image (forming a printed region) in a later part of the non-printed region a previous image. FIG. 18*c* depicts a leaf design whereby four leaf shapes have been printed on the web and further printing details have been directly printed over certain leaves.

Figure 19:
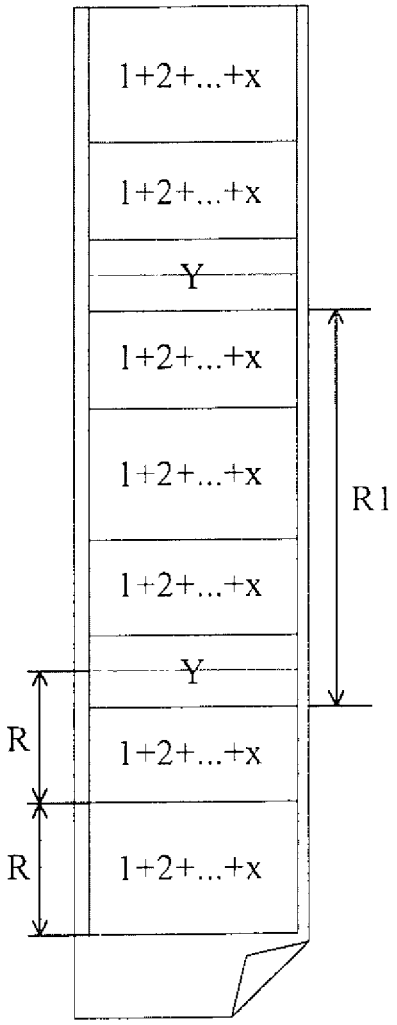

FIG. 19 depicts an example of a conventional web that has been overprinted by a random design Y having an image repeat length R1.

Figure 20C:
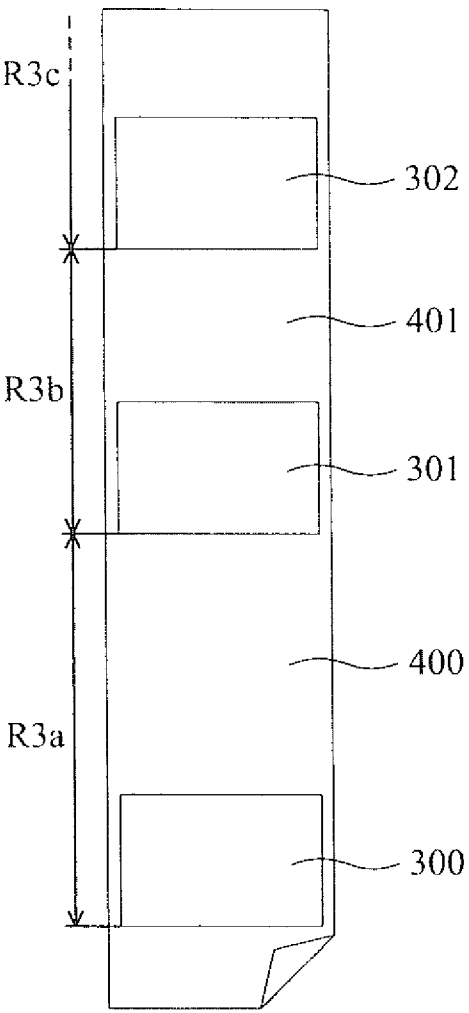
Figure 20B:
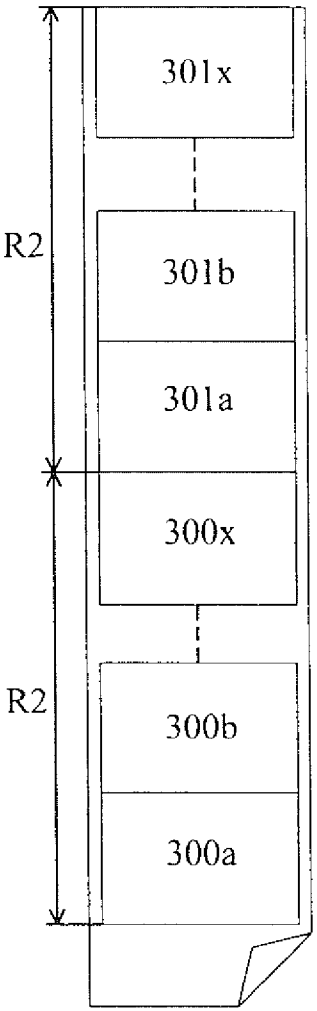
Figure 20A:
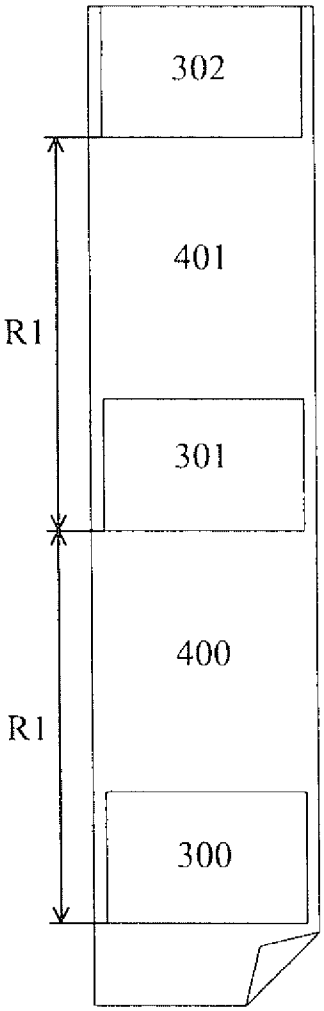

FIGS. 20*a* to 20*c* depict three different webs that have been printed using a printing roller comprising three printing zones and three non-printing zone (as shown in FIG. 6*a*), In FIG. 20*a*, the rotation of the printing roller has been controlled so as to print three equally spaced repeat portions (print region 300 and non-printed region 400 forms the first repeat portion etc). FIG. 20*b* depicts a web where x printing rollers (each having three printing zone and three non-printing zones) have been utilised to form a design comprising a repeating succession of different images (300*a*-300*x*; 301*a*-301*x*). Finally, FIG. 20*c* depicts a web that has been printed using a single printing roller having three printing zone (300, 301, 302) and three non-printing zones (400, 401. 402) whereby the non-printing regions vary in length.

A further aspect of the invention provides a web prepared using a flexographic printing station according to the invention described above.

A further aspect of the invention provides a web prepared using a flexographic printing system according to the invention described above.

A further aspect of the invention provides a web prepared using a flexographic method for printing a web according to the invention described above.

A further aspect of the invention provides a web prepared using a flexographic method for printing a design on a web according to the invention described above.

A further aspect of the invention provides a station or a system substantially as shown in the figures and described herein. A further aspect of the invention provides a method substantially as shown in the figures and described herein As explained previously, the present invention provides for the printing of designs that may have a large size format, that may have multiple images, may have images that are substantially spaced apart, that may have randomly located images, that may have overlaid images etc. Moreover, the present invention provides for the stable and accurate registration of printed images. Hence, the invention is suitable for printing highly complex designs requiring multiple images.

Through out the description and claims of this specification, the words "comprise" and "contain" and variations of the words, for example "comprising" and "comprise", means "including but not limited to, and is not intended to (and does not) exclude other moieties, additives, components, integers or steps.

Throughout the description and claims, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example, of the invention are to be understood to be applicable to any other aspect, embodiment or example described herein unless incompatible therewith.

What is claimed is:

1. A flexographic printing station for printing an image on a web comprising:

(a) a printing roller comprising at least one printing zone and at least one non-printing zone, wherein the at least one printing zone and the at least one non-printing zone are arranged on an outer surface of the printing roller and the at least one printing zone comprises a relief pattern;

(b) an ink supply means for supplying ink to the relief pattern;

(c) web line means for driving a web past the printing roller at a web line speed;

(d) control means for rotatably driving the printing roller:

(i) under a first rotational motion profile as the printing zone passes over the web, so as to print an image on the web; and (ii) under a second rotational motion profile, which is different from the first rotational motion profile as the non-printing zone passes over the web so as to form a non-printed region on the web that is longer than the circumferential length of the non-printing zone whereby either (A) random pattern repeat lengths are achieved by driving the printing roller to achieve random non-printed regions between successive images on the web printed by the at least one printing zone, or (B) variable pattern repeat lengths are achieved by driving the printing roller to achieve variable non-printed regions between successive images on the web printed by the at least one printing zone, and wherein the length of successive non-printed regions differ by an amount which exceeds an amount caused by registration tolerances.

2. A station according to claim 1, wherein the control means are configured to rotatably drive the printing roller during the first rotational motion profile at a predetermined printing speed.

3. A station according to claim 2, wherein the predetermined printing speed is at least substantially synchronised with the web line speed.

4. A station according to claim 2, wherein the predetermined printing speed is a speed suitable for providing a slip printing effect.

5. A station according to claim 1, wherein the control means are configured to rotatably drive the printing roller under the second rotational motion profile; such that (i) the rotation of the printing roller is suspended or the speed of rotation is reduced from the predetermined printing speed when the non-printing zone is in registration with the web; and (ii) the rotation of the printing roller is increased such that the printing roller is rotating at the predetermined printing speed as the subsequent printing zone is coming into the registration with the web.

6. A station according to claim 5, wherein the control means are further configured to reversibly drive the printing roller prior to increasing the speed of rotation to the predetermined printing speed.

7. A station according to claim 1, wherein the ink supply means comprises an anilox roller and an ink supply wherein the anilox roller is configured to transfer ink from the ink supply to the relief pattern.

8. A station according to claim 7, wherein the ink supply means further comprises a fountain roller arranged between the ink supply and the anilox roller, wherein the fountain roller is configured to transfer ink from the ink supply to the anilox roller.

9. A station according to claim 7, wherein the ink supply means further comprises an ink regulating means to remove excess ink from the anilox roller.

10. A station according to claim 1, further comprising an impression roller for supporting the web as the image is printed on the web.

11. A station according to claim 1, further comprising adjusting means to move the printing roller away from the web as the non-printing zone passes over the web and to re-position the printing roller so as to form printing contact with the web as the printing zone comes into registration with the web.

12. A station according to claim 1, further comprising adjusting means to move the ink supply means away from the printing roller so as to prevent ink transfer and to re-position the ink supply means relative to the printing roller so as to form inking contact with the printing roller.

13. A station according to claim 1, further comprising a key mark registration system to detect the position of the web with respect to the rotational position of the printing roller.

14. A station according to claim 13, wherein the key mark registration system comprises means to mark the web with respect to every desired printing region and, if required, initiate phase adjustment of printing roller so as to bring a predetermined printing zone of the printing roller into registration with a desired printing region.

15. A flexographic printing system for printing a design having a plurality of images; the system comprising:

(a) a plurality of flexographic printing stations, whereby at least one of the stations is a flexographic printing station as defined in claim 1 and;

(b) web line means to feed web between the rotary printing stations.

16. A method of flexographically printing a web with an image:

providing a flexographic printing station as defined in claim 1;

using the ink supply means to supply ink to the relief pattern;

using the web line means to feed a web past the printing roller at a web line speed;

using the control means to rotate the printing roller under the first rotational motion profile as the printing zone passes over the web, so as to print an image on the web; and using the control means to rotate the printing roller under the second rotational motion profile, which is different from the first rotational motion profile as the non-printing zone passes over the web so as to form a non-printed region on the web that is longer than the circumferential length of the non-printing zone whereby either (A) random pattern repeat lengths are achieved by driving the printing roller to achieve random non-printed regions between successive images on the web printed by the at least one printing zone, or (B) variable pattern repeat lengths are achieved by driving the printing roller to achieve variable non-printed regions between successive images on the web printed by the at least one printing zone, and wherein the length of successive non-printed regions differ by an amount which exceeds an amount caused by registration tolerances.

17. A method according to claim 16, wherein the step of rotating of the printing roller under the first rotational motion profile comprises rotating the printing roller at a predetermined printing speed when the printing zone is in registration with the web.

18. A method according to claim 17, wherein the step of rotating the printing roller at a predetermined printing speed comprises rotating the printing roller at a speed synchronised with the web line speed of the web.

19. A method according to claim 17, wherein the step of rotating the printing roller at a predetermined printing speed comprises rotating the printing roller at a speed suitable for providing a slip printing effect.

20. A method according to claim 16, wherein the step of rotating the printing roller under a second rotational motion profile comprises suspending the rotation of the printing roller or reducing the rotational speed of the printing roller from the printing speed when a non-printing zone is in registration with the web; and increasing the rotation of the printing roller to the predetermined printing speed as the printing zone comes into registration with the web.

21. A method according to claim 20, wherein the step of rotating the printing roller under the second rotational motion profile further comprises reversibly rotating the printing roller prior to increasing the rotation of the speed to the predetermined printing speed.

22. A method according to claim 16, wherein the step of supplying ink to the relief pattern comprises transferring ink from the ink supply to the relief pattern via the anilox roller.

23. A method according to claim 16, further comprising:

using the ink regulating means to remove excess ink from the anilox roller.

24. A method according to claim 16, further comprising:

using the impression roller to support the web as an image is printed onto the web.

25. A method according to claim 16, further comprising: using the adjusting means to move the printing roller away from the web when a non-printing zone passes over the web and then re-position the printing roller relative to the web so as to form printing contact with the web as the printing zone comes into registration with the web.

26. A method according to claim 16, further comprising: using the adjusting means to move the ink supply means away from the printing roller so as to prevent ink transfer and then re-position the ink supply means relative to the printing roller so as to form inking contact with the printing roller.

27. A method according to claim 16, further comprising: using the key mark registration system to print a mark on the web with respect to every desired printed region and, if required, to adjust the phase of the printing roller so as to bring the desired printed region into registration with a predetermined printing zone.

* * * * *